US010781765B2

(12) United States Patent
Hoshi et al.

(10) Patent No.: US 10,781,765 B2
(45) Date of Patent: Sep. 22, 2020

(54) CONTROL SYSTEM OF INTERNAL COMBUSTION ENGINE

(71) Applicant: TOYOTA JIDOSHA KABUSHIKI KAISHA, Toyota-shi, Aichi (JP)

(72) Inventors: Koichi Hoshi, Susono (JP); Norihisa Nakagawa, Susono (JP); Shuntaro Okazaki, Sunto-gun (JP); Yuji Yamaguchi, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 591 days.

(21) Appl. No.: 15/329,440

(22) PCT Filed: Jul. 28, 2015

(86) PCT No.: PCT/JP2015/003788
§ 371 (c)(1),
(2) Date: Jan. 26, 2017

(87) PCT Pub. No.: WO2016/017154
PCT Pub. Date: Feb. 4, 2016

(65) Prior Publication Data

US 2017/0211496 A1 Jul. 27, 2017

(30) Foreign Application Priority Data

Jul. 28, 2014 (JP) ..... 2014-153229

(51) Int. Cl.
*F01N 11/00* (2006.01)
*F01N 3/08* (2006.01)
(Continued)

(52) U.S. Cl.
CPC ..... *F02D 41/1454* (2013.01); *F01N 3/0864* (2013.01); *F01N 11/002* (2013.01);
(Continued)

(58) Field of Classification Search
CPC .... F01N 11/002; F01N 11/007; F01N 3/0864; F02D 41/0275; F02D 41/0295; F02D 41/1439; F02D 41/1445; F02D 41/1454
See application file for complete search history.

(56) References Cited

U.S. PATENT DOCUMENTS

2008/0066449 A1* 3/2008 Murata ..... B01D 53/9495 60/285
2008/0295488 A1 12/2008 Takubo
(Continued)

FOREIGN PATENT DOCUMENTS

EP 2 711 519 A1 3/2014
EP 3 146 187 A1 11/2015
(Continued)

*Primary Examiner* — Phutthiwat Wongwian
*Assistant Examiner* — Diem T Tran
(74) *Attorney, Agent, or Firm* — Finnegan, Henderson, Farabow, Garrett & Dunner, LLP

(57) ABSTRACT

An internal combustion engine comprises an exhaust purification catalyst, a downstream side air-fuel ratio sensor which is arranged at a downstream side of the exhaust purification catalyst, and an air flow meter which detects an amount of intake air. The control system of the internal combustion engine controls the exhaust air-fuel ratio to a target air-fuel ratio by feedback control, sets the target air-fuel ratio at a lean air-fuel ratio when the output air-fuel ratio of the downstream side air-fuel ratio sensor becomes a rich air-fuel ratio, and sets the target air-fuel ratio at a rich air-fuel ratio when the output air-fuel ratio of the downstream side air-fuel ratio sensor becomes a lean air-fuel ratio. When a change in the amount of intake air occurs so that it increases, the lean degree is set lower than before, in at least part of the time period during which the target air-fuel ratio is set to the lean air-fuel ratio, and the rich degree is set lower than before, in at least part of the timer period during which the target air-fuel ratio is set to the rich air-fuel ratio.

10 Claims, 16 Drawing Sheets

(51) Int. Cl.
*F02D 41/14* (2006.01)
*F02D 41/02* (2006.01)

(52) U.S. Cl.
CPC ..... *F01N 11/007* (2013.01); *F02D 41/0275* (2013.01); *F02D 41/0295* (2013.01); *F02D 41/1439* (2013.01); *F02D 41/1445* (2013.01)

(56) References Cited

U.S. PATENT DOCUMENTS

| | | | | |
|---|---|---|---|---|
| 2010/0146936 | A1 | 6/2010 | Sawada | |
| 2010/0217506 | A1* | 8/2010 | Mizoguchi ..... | F01N 11/007 701/109 |
| 2012/0067028 | A1* | 3/2012 | Clerc ..... | F01N 3/208 60/274 |
| 2016/0017831 | A1 | 1/2016 | Nakagawa et al. | |

FOREIGN PATENT DOCUMENTS

| | | | | |
|---|---|---|---|---|
| EP | 3 075 992 | A1 | | 10/2016 |
| JP | 8-312408 | | | 11/1996 |
| JP | 2011-069337 | | * | 4/2011 |
| JP | 2013-148024 | | * | 8/2013 |
| WO | WO 2014/118889 | A1 | | 8/2014 |
| WO | WO 2015/105013 | A1 | | 7/2015 |
| WO | WO 2015/177996 | A1 | | 11/2015 |

* cited by examiner (A)

(B)

CONTROL SYSTEM OF INTERNAL COMBUSTION ENGINE

CROSS-REFERENCE TO RELATED APPLICATIONS

This application is a national phase application of International Application No. PCT/JP2015/003788, filed Jul. 28, 2015, and claims the priority of Japanese Application No. 2014-153229, filed Jul. 28, 2014, the content of both of which is incorporated herein by reference.

TECHNICAL FIELD

The present invention relates to a control system of an internal combustion engine.

BACKGROUND ART

A control system of an internal combustion engine which is provided with an air-fuel ratio sensor or oxygen sensor in an exhaust passage of the internal combustion engine and controls an amount of fuel, which is fed to the internal combustion engine, based on an output of the air-fuel ratio sensor or oxygen sensor is well known. In particular, as such a control system, one which is provided with air-fuel ratio sensors at an upstream side and a downstream side, in a direction of exhaust flow, from an exhaust purification catalyst which is provided in the engine exhaust passage, has been proposed (for example, PTL 1).

In particular, in the control system described in PTL 1, a fuel feed device which feeds fuel to the inside of the exhaust passage is provided at the downstream side from the engine body and the upstream side from the exhaust purification catalyst. Further, when heating the exhaust purification catalyst, the amount of fuel which should be fed from the fuel feed device is calculated, based on the output of the air-fuel ratio (below, also referred to as the "output air-fuel ratio") detected by the upstream side air-fuel ratio sensor, so that the air-fuel ratio of the exhaust gas flowing into the exhaust purification catalyst becomes the stoichiometric air-fuel ratio. In addition, when the output air-fuel ratio of the downstream side air-fuel ratio sensor has not become the stoichiometric air-fuel ratio, the amount of fuel fed from the fuel feed device is corrected so that the output air-fuel ratio becomes the stoichiometric air-fuel ratio.

CITATION LIST

Patent Literature

PTL 1: Japanese Patent Publication No. H8-312408 A

SUMMARY OF INVENTION

Technical Problem

In this regard, according to the inventors of the present application, a control system performing control which is different from the control system described in the above-mentioned PTL 1, has been proposed. In this control system, when the output air-fuel ratio of the downstream side air-fuel ratio sensor has become a rich judged air-fuel ratio (air-fuel ratio slightly richer than the stoichiometric air-fuel ratio) or less, the target air-fuel ratio is set to an air-fuel ratio which is leaner than the stoichiometric air-fuel ratio (below, referred to as the "lean air-fuel ratio"). On the other hand, when the output air-fuel ratio of the downstream side air-fuel ratio sensor has become a lean judged air-fuel ratio (air-fuel ratio slightly leaner than the stoichiometric air-fuel ratio) or more, the target air-fuel ratio is set to an air-fuel ratio which is richer than the stoichiometric air-fuel ratio (below, referred to as the "rich air-fuel ratio"). That is, in this control system, the target air-fuel ratio is alternately switched between the rich air-fuel ratio and the lean air-fuel ratio.

When performing such control, if the oxygen storage amount of the exhaust purification catalyst becomes a suitable amount between zero and a maximum storable oxygen amount, there is little outflow of oxygen, $NO_x$, or unburned gas (HC or CO) from the exhaust purification catalyst. However, for example, when the flow amount of the exhaust gas flowing into the exhaust purification catalyst is large or when the ability of the exhaust purification catalyst to purify unburned gas, etc., falls, sometimes despite the oxygen storage amount of the exhaust purification catalyst being a suitable amount, oxygen, $NO_x$, and unburned gas will flows out.

Therefore, in view of the above problem, an object of the present invention is to provide a control system of an internal combustion engine which can suppress the outflow of $NO_x$ or unburned gas from an exhaust purification catalyst.

Solution to Problem

To solve the above problem, the following inventions are provided.

(1) A control system of internal combustion engine, the engine comprising: an exhaust purification catalyst which is arranged in an exhaust passage of the internal combustion engine and which can store oxygen; a downstream side air-fuel ratio sensor which is arranged at a downstream side, in the direction of exhaust flow, from the exhaust purification catalyst and which detects the air-fuel ratio of the exhaust gas flowing out from the exhaust purification catalyst; and a flow velocity detecting device which detects or estimates a flow velocity of exhaust gas flowing through the exhaust purification catalyst, wherein the control system: controls the air-fuel ratio of the exhaust gas flowing into the exhaust purification catalyst, by feedback control, to become a target air-fuel ratio; sets the target air-fuel ratio to a lean air-fuel ratio which is leaner than the stoichiometric air-fuel ratio, when the output air-fuel ratio of the downstream side air-fuel ratio sensor becomes equal to or less than a rich judged air-fuel ratio, which is richer than the stoichiometric air-fuel ratio; sets the target air-fuel ratio to a rich air-fuel ratio which is richer than the stoichiometric air-fuel ratio, when the output air-fuel ratio of the downstream side air-fuel ratio sensor becomes equal to or greater than a lean judged air-fuel ratio, which is leaner than the stoichiometric air-fuel ratio; and, when a change in the flow velocity of exhaust gas flowing through the exhaust purification catalyst, which is detected or estimated by the flow velocity detecting device, occurs so that the flow velocity becomes faster, sets the lean degree to lower than before, during at least part of the time period during which the target air-fuel ratio is set to the lean air-fuel ratio, and/or sets the rich degree to lower than before, during at least part of the time period during which the target air-fuel ratio is set to the rich air-fuel ratio.

(2) A control system of internal combustion engine, the engine comprising: an exhaust purification catalyst which is arranged in an exhaust passage of the internal combustion engine and which can store oxygen; a downstream side air-fuel ratio sensor which is arranged at a downstream side, in the direction of exhaust flow, from the exhaust purification catalyst and which detects the air-fuel ratio of the exhaust gas flowing out from the exhaust purification catalyst; and a purification ability detecting device which detects or estimates the value of a purification ability parameter which indicates a purification ability of the exhaust purification catalyst, wherein the control system: controls the air-fuel ratio of the exhaust gas flowing into the exhaust purification catalyst, by feedback control, to become a target air-fuel ratio; sets the target air-fuel ratio to a lean air-fuel ratio which is leaner than the stoichiometric air-fuel ratio when the output air-fuel ratio of the downstream side air-fuel ratio sensor becomes equal to or less than a rich judged air-fuel ratio, which is richer than the stoichiometric air-fuel ratio; sets the target air-fuel ratio to a rich air-fuel ratio which is richer than the stoichiometric air-fuel ratio, when the output air-fuel ratio of the downstream side air-fuel ratio sensor becomes equal to or greater than a lean judged air-fuel ratio, which is leaner than the stoichiometric air-fuel ratio; and, when a change in the value of the purification ability parameter, which is detected or estimated by the purification ability detecting device, occurs so that the purification ability falls, sets the lean degree to lower than before, during at least part of the time period during which the target air-fuel ratio is set to the lean air-fuel ratio, and/or sets the rich degree to lower than before, during at least part of the time period during which the target air-fuel ratio is set to the rich air-fuel ratio.

(3) The control system of an internal combustion engine according to the above (2), wherein the purification ability parameter is the temperature of the exhaust purification catalyst or the degree of deterioration of the exhaust purification catalyst.

(4) The control system of an internal combustion engine according to any one of the above (1) to (3), wherein the control system: sets the target air-fuel ratio to a lean set air-fuel ratio, which is leaner than the stoichiometric air-fuel ratio, when the output air-fuel ratio of the downstream side air-fuel ratio sensor becomes equal to or less than the rich judged air-fuel ratio; sets the target air-fuel ratio to a lean air-fuel ratio with a smaller lean degree than the lean set air-fuel ratio from a lean degree change timing after the target air-fuel ratio is set to the lean set air-fuel ratio and before the output air-fuel ratio of the downstream side air-fuel ratio sensor becomes equal to or greater than the lean judged air-fuel ratio, until the output air-fuel ratio of the downstream side air-fuel ratio sensor becomes equal to or greater than the lean judged air-fuel ratio; and lowers a lean degree of the lean set air-fuel ratio when the change occurs.

(5) The control system of an internal combustion engine according to the above (4), wherein when the change occurs, the control system lowers the lean degree of the air-fuel ratio from the lean degree change timing to when the output air-fuel ratio of the downstream side air-fuel ratio sensor becomes equal to or greater than the lean judged air-fuel ratio.

(6) The control system of an internal combustion engine according to any one of the above (1) to (3), wherein the control system: sets the target air-fuel ratio to a lean set air-fuel ratio, which is leaner than the stoichiometric air-fuel ratio, when the output air-fuel ratio of the downstream side air-fuel ratio sensor becomes equal to or less than the rich judged air-fuel ratio; sets the target air-fuel ratio to a lean air-fuel ratio with a smaller lean degree than the lean set air-fuel ratio from a lean degree change timing after the target air-fuel ratio is set to the lean set air-fuel ratio and before the output air-fuel ratio of the downstream side air-fuel ratio sensor becomes equal to or greater than the lean judged air-fuel ratio until the output air-fuel ratio of the downstream side air-fuel ratio sensor becomes equal to or greater than the lean judged air-fuel ratio; and, when the change occurs, lowers the lean degree of the air-fuel ratio from the lean degree change timing to when the output air-fuel ratio of the downstream side air-fuel ratio sensor becomes equal to or greater than the lean judged air-fuel ratio or more.

(7) The control system of an internal combustion engine according to any one of the above (4) to (6), wherein even when lowering the lean degree, the target air-fuel ratio is set to equal to or greater than the lean judged air-fuel ratio.

(8) The control system of an internal combustion engine according to any one of the above (1) to (7), wherein the control system: sets the target air-fuel ratio to a rich set air-fuel ratio, which is richer than the stoichiometric air-fuel ratio, when the output air-fuel ratio of the downstream side air-fuel ratio sensor becomes equal to or greater than the lean judged air-fuel ratio; sets the target air-fuel ratio to a rich air-fuel ratio with a smaller rich degree than the rich set air-fuel ratio from a rich degree change timing after the target air-fuel ratio is set to the rich set air-fuel ratio and before the output air-fuel ratio of the downstream side air-fuel ratio sensor becomes equal to or less than the rich judged air-fuel ratio, until the output air-fuel ratio of the downstream side air-fuel ratio sensor becomes equal to or less than the rich judged air-fuel ratio; and lowers a rich degree of the rich set air-fuel ratio when the change occurs.

(9) The control system of an internal combustion engine according to the above (8), wherein when the change occurs, the control system lowers the rich degree of the air-fuel ratio from the rich degree change timing to when the output air-fuel ratio of the downstream side air-fuel ratio sensor becomes equal to or less than the rich judged air-fuel ratio.

(10) The control system of an internal combustion engine according to any one of the above (1) to (7), wherein the control system: sets the target air-fuel ratio to a rich set air-fuel ratio, which is richer than the stoichiometric air-fuel ratio, when the output air-fuel ratio of the downstream side air-fuel ratio sensor becomes equal to or greater than the lean judged air-fuel ratios; sets the target air-fuel ratio to a rich air-fuel ratio with a smaller rich degree than the rich set air-fuel ratio from a rich degree change timing after the target air-fuel ratio is set to the rich set air-fuel ratio and before the output air-fuel ratio of the downstream side air-fuel ratio sensor becomes equal to or less than the rich judged air-fuel ratio until the output air-fuel ratio of the downstream side air-fuel ratio sensor becomes equal to or less than the rich judged air-fuel ratio or less; and, when the change occurs, lowers the rich degree of the air-fuel ratio from the rich degree change timing to when the output air-fuel ratio of the downstream side air-fuel ratio sensor becomes equal to or less than the rich judged air-fuel ratio or less.

(11) The control system of an internal combustion engine according to any one of the above (8) to (10), wherein even when lowering the rich degree, the target air-fuel ratio is set to equal to or less than the rich judged air-fuel ratio.

Advantageous Effects of Invention

According to the present invention, a control system of an internal combustion engine which can suppress the outflow of $NO_x$ or unburned gas from an exhaust purification catalyst is provided.

DESCRIPTION OF EMBODIMENTS

Figure 1:
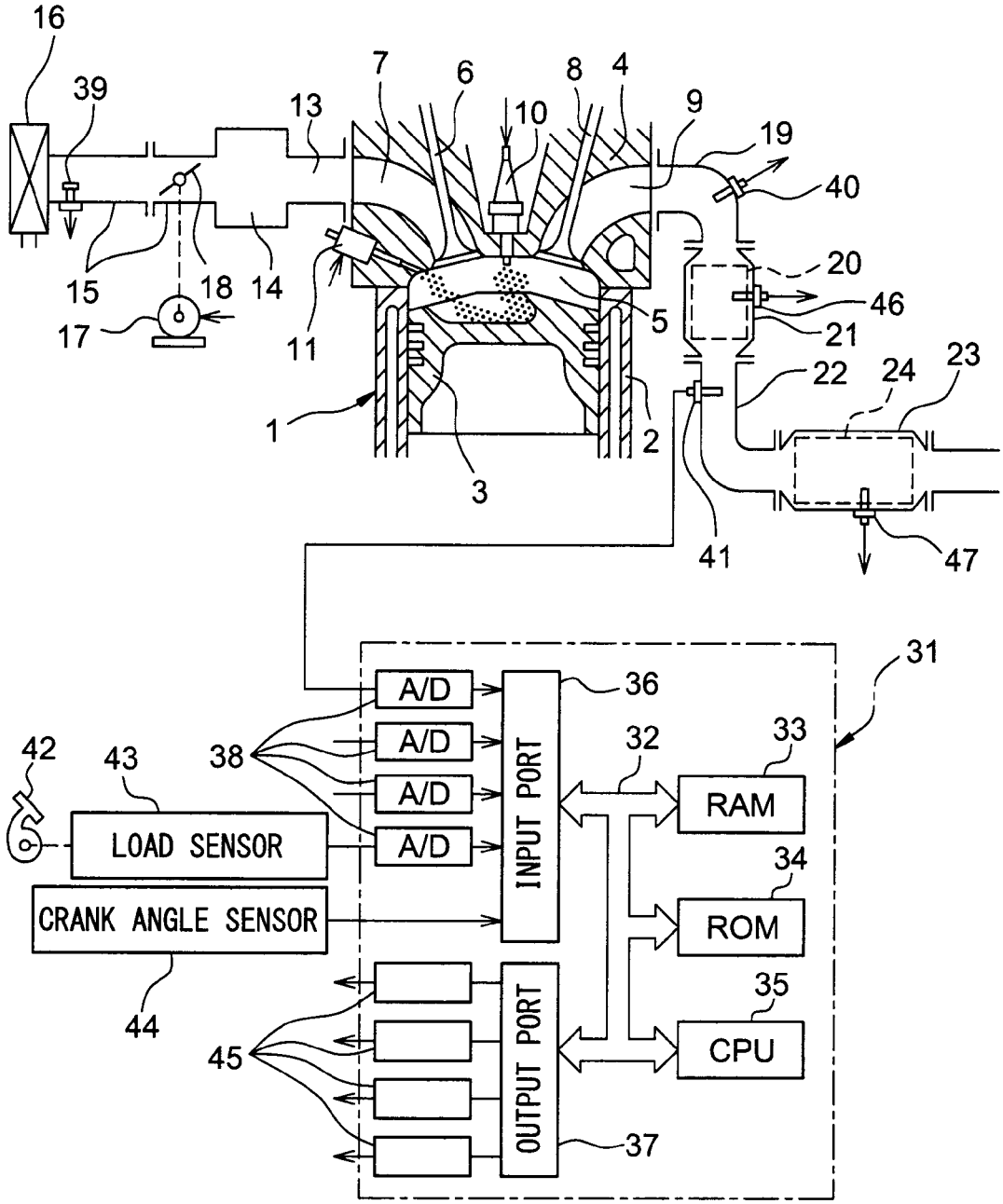
FIG. 1 is a view which schematically shows an internal combustion engine in which a control system of the present invention is used.

Below, referring to the drawings, embodiments of the present invention will be explained in detail. Note that, in the following explanation, similar components are assigned the same reference numerals.

Explanation of Internal Combustion Engine as a Whole

FIG. 1 is a view which schematically shows an internal combustion engine in which a control device according to the present invention is used. Referring to FIG. 1, 1 indicates an engine body, 2 a cylinder block, 3 a piston which reciprocates in the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a fuel injector 11 is arranged at a peripheral part of the inner wall surface of the cylinder head 4. The spark plug 10 is configured to generate a spark in accordance with an ignition signal. Further, the fuel injector 11 injects a predetermined amount of fuel into the combustion chamber 5 in accordance with an injection signal. Note that, the fuel injector 11 may also be arranged so as to inject fuel into the intake port 7. Further, in the present embodiment, as the fuel, gasoline with a stoichiometric air-fuel ratio of 14.6 is used. However, the internal combustion engine of the present embodiment may also use another kind of fuel.

The intake port 7 of each cylinder is connected to a surge tank 14 through a corresponding intake runner 13, while the surge tank 14 is connected to an air cleaner 16 through an intake pipe 15. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of runners which are connected to the exhaust ports 9 and a collected part at which these runners are collected. The collected part of the exhaust manifold 19 is connected to an upstream side casing 21 which houses an upstream side exhaust purification catalyst 20. The upstream side casing 21 is connected through an exhaust pipe 22 to a downstream side casing 23 which houses a downstream side exhaust purification catalyst 24. The exhaust port 9, exhaust manifold 19, upstream side casing 21, exhaust pipe 22, and downstream side casing 23 form an exhaust passage.

The electronic control unit (ECU) 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an airflow meter 39 is arranged for detecting the flow rate of air flowing through the intake pipe 15. The output of this airflow meter 39 is input through a corresponding AD converter 38 to the input port 36. Further, at the collected part of the exhaust manifold 19, an upstream side air-fuel ratio sensor 40 is arranged which detects the air-fuel ratio of the exhaust gas flowing through the inside of the exhaust manifold 19 (that is, the exhaust gas flowing into the upstream side exhaust purification catalyst 20). In addition, in the exhaust pipe 22, a downstream side air-fuel ratio sensor 41 is arranged which detects the air-fuel ratio of the exhaust gas flowing through the inside of the exhaust pipe 22 (that is, the exhaust gas flowing out from the upstream side exhaust purification catalyst 20 and flowing into the downstream side exhaust purification catalyst 24). The outputs of these air-fuel ratio sensors 40 and 41 are also input through the corresponding AD converters 38 to the input port 36. Furthermore, at the upstream side exhaust purification catalyst 20, an upstream side temperature sensor 46 which detects the temperature of the upstream side exhaust purification catalyst 20 is arranged, while at the downstream side exhaust purification catalyst 24, a downstream side temperature sensor 47 which detects the temperature of the downstream side exhaust purification catalyst 24 is arranged. The outputs of these temperature sensors 46 and 47 are also input through the corresponding AD converters 38 to the input port 36.

Further, an accelerator pedal 42 is connected to a load sensor 43 generating an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that the ECU 31 functions as a control device for controlling the internal combustion engine.

Note that, the internal combustion engine according to the present embodiment is a non-supercharged internal combustion engine which is fueled by gasoline, but the internal combustion engine according to the present invention is not limited to the above configuration. For example, the internal combustion engine according to the present invention may have cylinder array, state of injection of fuel, configuration of intake and exhaust systems, configuration of valve mechanism, presence of supercharger, and/or supercharged state, etc. which are different from the above internal combustion engine.

Explanation of Exhaust Purification Catalyst

The upstream side exhaust purification catalyst 20 and downstream side exhaust purification catalyst 24 in each case have similar configurations. The exhaust purification catalysts 20 and 24 are three-way catalysts having oxygen storage abilities. Specifically, the exhaust purification catalysts 20 and 24 are formed such that on substrate consisting of ceramic, a precious metal having a catalytic action (for example, platinum (Pt)) and a substance having an oxygen storage ability (for example, ceria ($CeO_2$)) are carried. The exhaust purification catalysts 20 and 24 exhibit a catalytic action of simultaneously removing unburned gas (HC, CO, etc.) and nitrogen oxides ($NO_x$) and, in addition, an oxygen storage ability, when reaching a predetermined activation temperature.

According to the oxygen storage ability of the exhaust purification catalysts 20 and 24, the exhaust purification catalysts 20 and 24 store the oxygen in the exhaust gas when the air-fuel ratio of the exhaust gas flowing into the exhaust purification catalysts 20 and 24 is leaner than the stoichiometric air-fuel ratio (lean air-fuel ratio). On the other hand, the exhaust purification catalysts 20 and 24 release the oxygen stored in the exhaust purification catalysts 20 and 24 when the air-fuel ratio of the inflowing exhaust gas is richer than the stoichiometric air-fuel ratio (rich air-fuel ratio).

The exhaust purification catalysts 20 and 24 have a catalytic action and oxygen storage ability and thereby have the action of purifying $NO_x$ and unburned gas according to the stored amount of oxygen. That is, in the case where the air-fuel ratio of the exhaust gas flowing into the exhaust purification catalysts 20 and 24 is a lean air-fuel ratio, as shown in FIG. 2(A), when the stored amount of oxygen is small, the exhaust purification catalysts 20 and 24 store the oxygen in the exhaust gas. Further, along with this, the $NO_x$ in the exhaust gas is reduced and purified. On the other hand, if the stored amount of oxygen becomes larger beyond a certain stored amount (in the figure, Cuplim) near the maximum storable oxygen amount (upper limit storage amount) Cmax, the exhaust gas flowing out from the exhaust purification catalysts 20 and 24 rapidly rises in concentration of oxygen and $NO_x$.

On the other hand, in the case where the air-fuel ratio of the exhaust gas flowing into the exhaust purification catalysts 20 and 24 is the rich air-fuel ratio, as shown in FIG. 2(B), when the stored amount of oxygen is large, the oxygen stored in the exhaust purification catalysts 20 and 24 is released, and the unburned gas in the exhaust gas is oxidized and purified. On the other hand, if the stored amount of oxygen becomes small, the exhaust gas flowing out from the exhaust purification catalysts 20 and 24 rapidly rises in concentration of unburned gas at a certain stored amount (in the figure, Clowlim) near zero (lower limit storage amount).

In the above way, according to the exhaust purification catalysts 20 and 24 used in the present embodiment, the purification characteristics of $NO_x$ and unburned gas in the exhaust gas change depending on the air-fuel ratio and stored amount of oxygen of the exhaust gas flowing into the exhaust purification catalysts 20 and 24. Note that, as long as having a catalytic action and oxygen storage ability, the exhaust purification catalysts 20 and 24 may be any catalyst.

Output Characteristic of Air-Fuel Ratio Sensor

Figure 3:
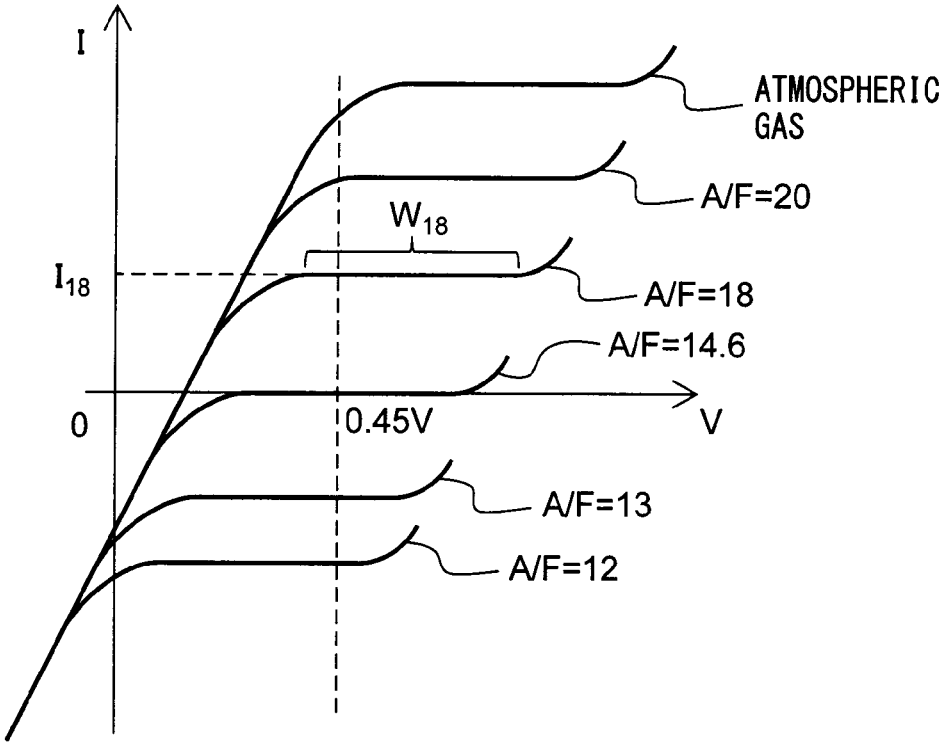
FIG. 3 is a view which shows a relationship between a sensor applied voltage and output current at different exhaust air-fuel ratios.
Figure 4:
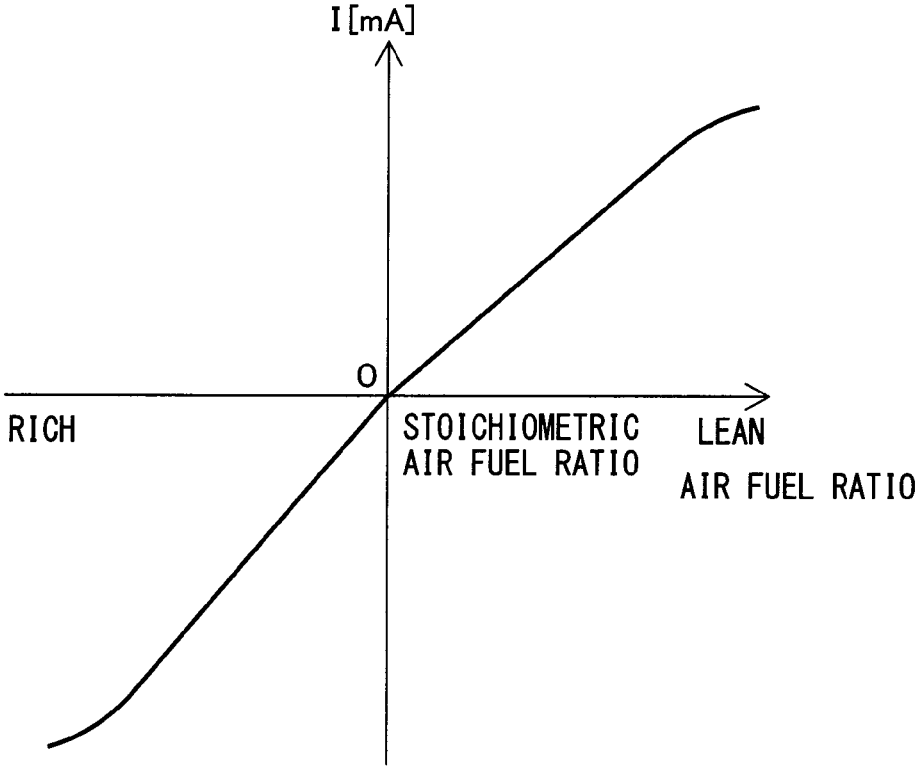
FIG. 4 is a view which shows a relationship between an exhaust air-fuel ratio and output current when making a sensor applied voltage constant.

Next, referring to FIGS. 3 and 4, the output characteristic of air-fuel ratio sensors 40 and 41 in the present embodiment will be explained. FIG. 3 is a view showing the voltage-current (V-I) characteristic of the air-fuel ratio sensors 40 and 41 of the present embodiment. FIG. 4 is a view showing the relationship between air-fuel ratio of the exhaust gas (below, referred to as "exhaust air-fuel ratio") flowing around the air-fuel ratio sensors 40 and 41 and output current I, when making the supplied voltage constant. Note that, in this embodiment, the air-fuel ratio sensor having the same configurations is used as both air-fuel ratio sensors 40 and 41.

As will be understood from FIG. 3, in the air-fuel ratio sensors 40 and 41 of the present embodiment, the output current I becomes larger the higher (the leaner) the exhaust air-fuel ratio. Further, the line V-I of each exhaust air-fuel ratio has a region substantially parallel to the V axis, that is, a region where the output current does not change much at all even if the supplied voltage of the sensor changes. This voltage region is called the "limit current region". The current at this time is called the "limit current". In FIG. 3, the limit current region and limit current when the exhaust air-fuel ratio is 18 are shown by $W_{18}$ and $I_{18}$, respectively. Therefore, the air-fuel ratio sensors 40 and 41 can be referred to as "limit current type air-fuel ratio sensors".

FIG. 4 is a view which shows the relationship between the exhaust air-fuel ratio and the output current I when making the supplied voltage constant at about 0.45V. As will be understood from FIG. 4, in the air-fuel ratio sensors 40 and 41, the output current I varies linearly (proportionally) with respect to the exhaust air-fuel ratio such that the higher (that is, the leaner) the exhaust air-fuel ratio, the greater the output current I from the air-fuel ratio sensors 40 and 41. In addition, the air-fuel ratio sensors 40 and 41 are configured so that the output current I becomes zero when the exhaust air-fuel ratio is the stoichiometric air-fuel ratio. Further, when the exhaust air-fuel ratio becomes larger by a certain extent or more or when it becomes smaller by a certain extent or more, the ratio of change of the output current to the change of the exhaust air-fuel ratio becomes smaller.

Note that, in the above example, as the air-fuel ratio sensors 40 and 41, limit current type air-fuel ratio sensors are used. However, as the air-fuel ratio sensors 40 and 41, it is also possible to use air-fuel ratio sensor not a limit current type or any other air-fuel ratio sensor, as long as the output current varies linearly with respect to the exhaust air-fuel ratio. Further, the air-fuel ratio sensors 40 and 41 may have structures different from each other.

Summary of Basic Air-Fuel Ratio Control

Next, air-fuel ratio control in the control system of an internal combustion engine of the present invention will be explained in brief. In the present embodiment, feedback control is performed to control the fuel injection amount from the fuel injector 11, based on the output air-fuel ratio of the upstream side air-fuel ratio sensor 40, so that the output air-fuel ratio of the upstream side air-fuel ratio sensor 40 becomes the target air-fuel ratio. Note that, "output air-fuel ratio" means an air-fuel ratio corresponding to the output value of the air-fuel ratio sensor.

Further, in air-fuel ratio control of the present embodiment, the target air-fuel ratio setting control is performed to set the target air-fuel ratio based on the output air-fuel ratio of the downstream side air-fuel ratio sensor 41, etc. In the target air-fuel ratio setting control, when the output air-fuel ratio of the downstream side air-fuel ratio sensor 41 becomes a rich judged air-fuel ratio which is just slightly richer than the stoichiometric air-fuel ratio (for example, 14.55) or less, it is judged that the air-fuel ratio of the exhaust gas detected by the downstream side air-fuel ratio sensor 41 has become the rich air-fuel ratio. At this time, the target air-fuel ratio is set to a lean set air-fuel ratio. Note that, the "lean set air-fuel ratio" is a predetermined air-fuel ratio which is leaner than the stoichiometric air-fuel ratio by a certain degree, for example, 14.65 to 20, preferably 14.65 to 18, more preferably 14.65 to 16 or so.

After that, if, in the state where the target air-fuel ratio is set to the lean set air-fuel ratio, the output air-fuel ratio of the downstream side air-fuel ratio sensor 41 becomes an air-fuel ratio which is leaner than a rich judged air-fuel ratio (air-fuel ratio which is closer to stoichiometric air-fuel ratio than rich judged air-fuel ratio), it is judged that the air-fuel ratio of the exhaust gas detected by the downstream side air-fuel ratio sensor 41 has become substantially the stoichiometric air-fuel ratio. At this time, the target air-fuel ratio is set to a slight lean set air-fuel ratio. Note that, the slight lean set air-fuel ratio is a lean air-fuel ratio with a smaller lean degree than the lean set air-fuel ratio (smaller difference from stoichiometric air-fuel ratio), for example, 14.62 to 15.7, preferably 14.63 to 15.2, more preferably 14.65 to 14.9 or so.

On the other hand, when the output air-fuel ratio of the downstream side air-fuel ratio sensor 41 becomes a lean judged air-fuel ratio which is slightly leaner than the stoichiometric air-fuel ratio (for example, 14.65) or more, it is judged that the air-fuel ratio of the exhaust gas detected by the downstream side air-fuel ratio sensor 41 has become the lean air-fuel ratio. At this time, the target air-fuel ratio is set to a rich set air-fuel ratio. Note that, the "rich set air-fuel ratio" is a predetermined air-fuel ratio which is richer by a certain extent from the stoichiometric air-fuel ratio, for example, 10 to 14.55, preferably 12 to 14.52, more preferably 13 to 14.5 or so.

After that, if, in the state where the target air-fuel ratio is set to the rich set air-fuel ratio, the output air-fuel ratio of the downstream side air-fuel ratio sensor 41 becomes an air-fuel ratio which is richer than the lean judged air-fuel ratio (air-fuel ratio which is closer to stoichiometric air-fuel ratio than lean judged air-fuel ratio), it is judged that the air-fuel ratio of the exhaust gas detected by the downstream side air-fuel ratio sensor 41 has become substantially the stoichiometric air-fuel ratio. At this time, the target air-fuel ratio is set to a slight rich set air-fuel ratio. Note that, the "slight rich set air-fuel ratio" is a rich air-fuel ratio with a smaller rich degree than the rich set air-fuel ratio (smaller difference from stoichiometric air-fuel ratio), for example, 13.5 to 14.58, preferably 14 to 14.57, more preferably 14.3 to 14.55 or so.

As a result, in the present embodiment, if the output air-fuel ratio of the downstream side air-fuel ratio sensor 41 becomes the rich judged air-fuel ratio or less, first, the target air-fuel ratio is set to the lean set air-fuel ratio. After that, if the output air-fuel ratio of the downstream side air-fuel ratio sensor 41 becomes larger than the rich judged air-fuel ratio, the target air-fuel ratio is set to the slight lean set air-fuel ratio. On the other hand, if the output air-fuel ratio of the downstream side air-fuel ratio sensor 41 becomes the lean judged air-fuel ratio or more, first, the target air-fuel ratio is set to the rich set air-fuel ratio. After that, if the output air-fuel ratio of the downstream side air-fuel ratio sensor 41 becomes smaller than the lean judged air-fuel ratio, the target air-fuel ratio is set to the slight rich set air-fuel ratio. After that, similar control is repeated.

Note that, the rich judged air-fuel ratio and lean judged air-fuel ratio are set to air-fuel ratios within 1% of the stoichiometric air-fuel ratio, preferably within 0.5%, more preferably within 0.35%. Therefore, the differences from the stoichiometric air-fuel ratio of the rich judged air-fuel ratio and the lean judged air-fuel ratio when the stoichiometric air-fuel ratio is 14.6 are 0.15 or less, preferably 0.073 or less, more preferably 0.051 or less. Further, the difference of the target air-fuel ratio (for example, slight rich set air-fuel ratio or lean set air-fuel ratio) from the stoichiometric air-fuel ratio is set to be larger than the above difference.

Explanation of Control Using Time Chart

Figure 5:
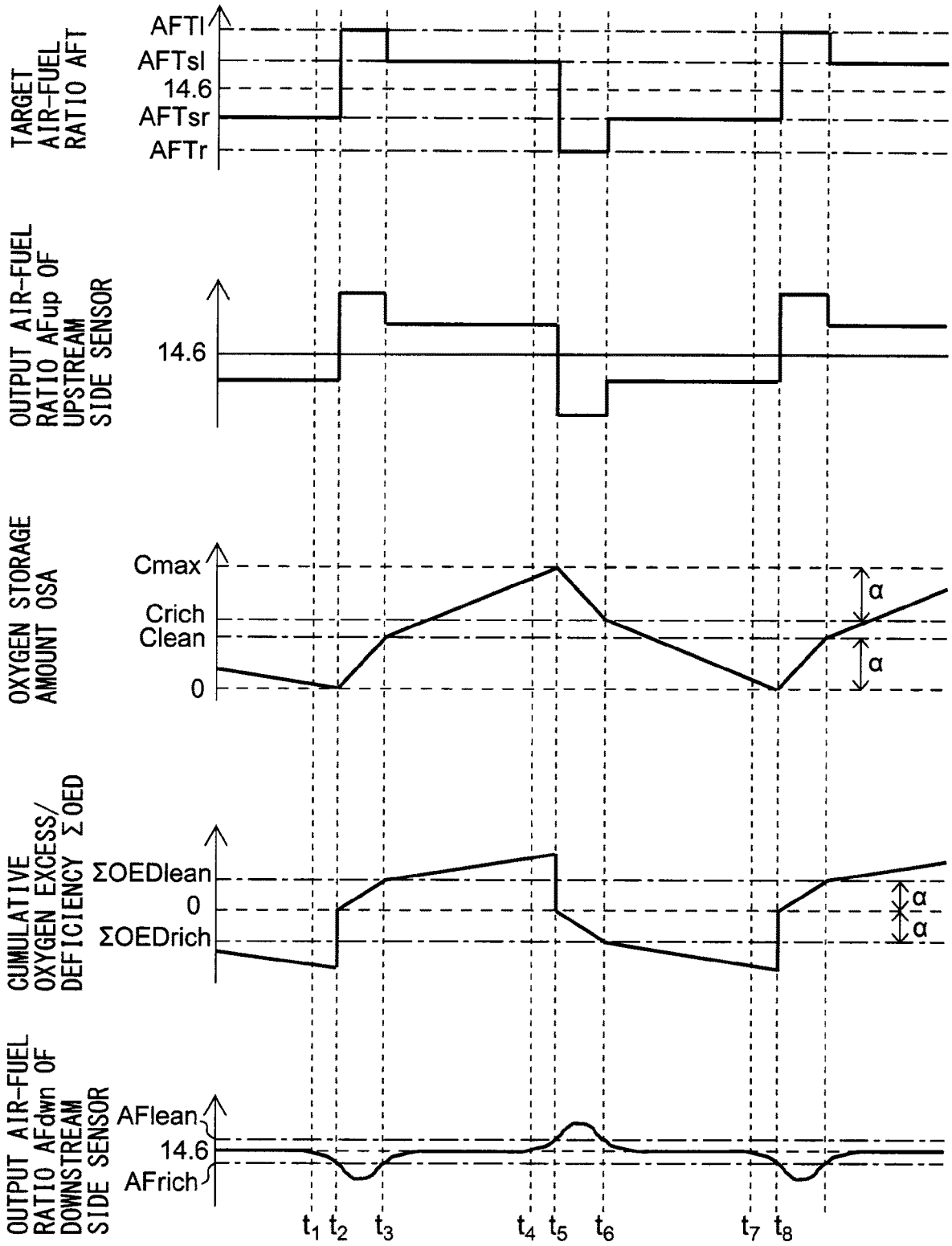
FIG. 5 is a time chart of an air-fuel ratio correction amount, etc., when performing basic air-fuel ratio control by a control system of an internal combustion engine according to the present embodiment.

Referring to FIG. 5, the above-mentioned operation will be explained in detail. FIG. 5 is a time chart of the target air-fuel ratio AFT, the output air-fuel ratio AFup of the upstream side air-fuel ratio sensor 40, the oxygen storage amount OSA of the upstream side exhaust purification catalyst 20, the cumulative oxygen excess/deficiency ΣOED of the exhaust gas flowing into the upstream side exhaust purification catalyst 20, and the output air-fuel ratio AFdwn of the downstream side air-fuel ratio sensor 41, in the case of performing basic air-fuel ratio control by a control system of an internal combustion engine according to the present embodiment.

In the illustrated example, in the state before the time $t_1$, the target air-fuel ratio AFT is set to a slight rich set air-fuel ratio AFTsr. Along with this, the output air-fuel ratio of the upstream side air-fuel ratio sensor 40 becomes the rich air-fuel ratio. The unburned gas contained in the exhaust gas flowing into the upstream side exhaust purification catalyst 20 is purified by the upstream side exhaust purification catalyst 20. Along with this, the oxygen storage amount OSA of the upstream side exhaust purification catalyst 20 gradually decreases. On the other hand, due to the purification at the upstream side exhaust purification catalyst 20, the exhaust gas flowing out from the upstream side exhaust purification catalyst 20 does not contain unburned gas, and therefore the output air-fuel ratio AFdwn of the downstream side air-fuel ratio sensor 41 becomes substantially the stoichiometric air-fuel ratio.

Figure 2:
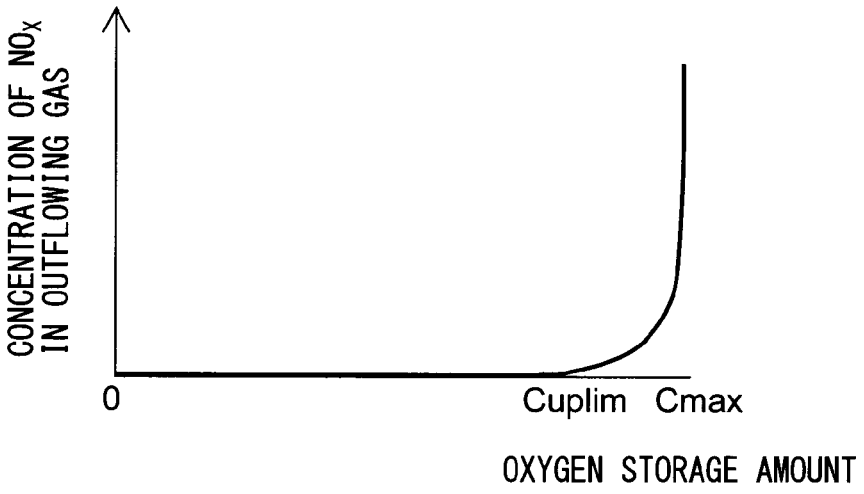
FIG. 2 is a view which shows a relationship between an oxygen storage amount of an exhaust purification catalyst and a concentration of $NO_x$ or concentration of HC and CO in exhaust gas flowing out from the exhaust purification catalyst.
Figure 2:
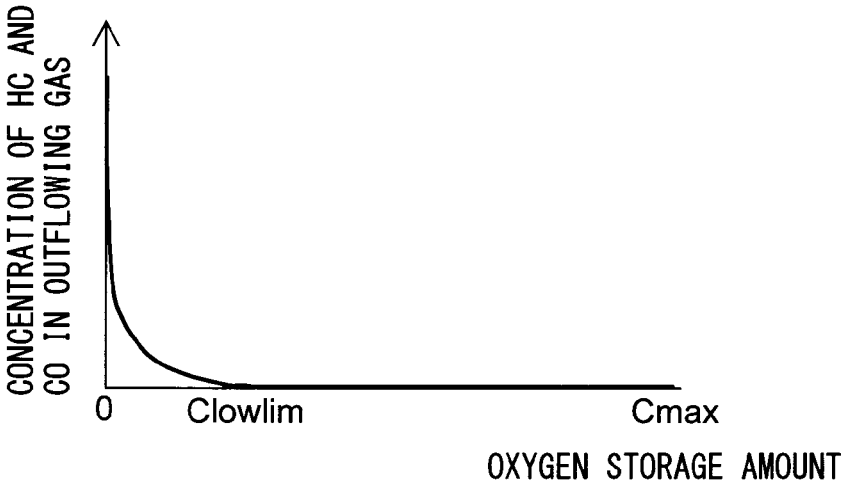

If the oxygen storage amount OSA of the upstream side exhaust purification catalyst 20 gradually decreases, the oxygen storage amount OSA approaches zero at the time $t_1$ (for example, in FIG. 2, Clowlim). Along with this, part of the unburned gas flowing into the upstream side exhaust purification catalyst 20 starts to flow out without being purified by the upstream side exhaust purification catalyst 20. Due to this, after the time $t_1$, the output air-fuel ratio AFdwn of the downstream side air-fuel ratio sensor 41 gradually falls. As a result, in the illustrated example, at the time $t_2$, the oxygen storage amount OSA becomes substantially zero and the output air-fuel ratio AFdwn of the downstream side air-fuel ratio sensor 41 reaches the rich judged air-fuel ratio AFrich.

In the present embodiment, if the output air-fuel ratio AFdwn of the downstream side air-fuel ratio sensor 41 becomes the rich judged air-fuel ratio AFrich or less, the target air-fuel ratio AFT is switched to the lean set air-fuel ratio AFTl so as to make the oxygen storage amount OSA increase. Therefore, the target air-fuel ratio is switched from the rich air-fuel ratio to the lean air-fuel ratio.

Note that, in the present embodiment, the target air-fuel ratio AFT is switched not right after the output air-fuel ratio AFdwn of the downstream side air-fuel ratio sensor 41 changes from the stoichiometric air-fuel ratio to the rich air-fuel ratio, but after reaching the rich judged air-fuel ratio AFrich. This is because even if the oxygen storage amount OSA of the upstream side exhaust purification catalyst 20 is sufficient, sometimes the air-fuel ratio of the exhaust gas flowing out from the upstream side exhaust purification catalyst 20 shifts slightly from the stoichiometric air-fuel ratio. Conversely speaking, the rich judged air-fuel ratio is made an air-fuel ratio which the air-fuel ratio of the exhaust gas flowing out from the upstream side exhaust purification catalyst 20 will never reach when the oxygen storage amount of the upstream side exhaust purification catalyst 20 is sufficient. Note that, the same can be said for the above-mentioned lean judged air-fuel ratio.

If, at the time $t_2$, the target air-fuel ratio is switched to the lean air-fuel ratio, the air-fuel ratio of the exhaust gas flowing into the upstream side exhaust purification catalyst 20 changes from the rich air-fuel ratio to the lean air-fuel ratio. Further, along with this, the output air-fuel ratio AFup of the upstream side air-fuel ratio sensor 40 becomes a lean air-fuel ratio (in actuality, a delay occurs from when switching the target air-fuel ratio to when the air-fuel ratio of the exhaust gas flowing into the upstream side exhaust purification catalyst 20 changes, but in the illustrated example, for convenience, it is assumed that they change simultaneously). If, at the time $t_2$, the air-fuel ratio of the exhaust gas flowing into the upstream side exhaust purification catalyst 20 changes to the lean air-fuel ratio, the oxygen storage amount OSA of the upstream side exhaust purification catalyst 20 increases.

If, in this way, the oxygen storage amount OSA of the upstream side exhaust purification catalyst 20 increases, the air-fuel ratio of the exhaust gas flowing out from the upstream side exhaust purification catalyst 20 changes toward the stoichiometric air-fuel ratio. In the example shown in FIG. 5, at the time $t_3$, the output air-fuel ratio AFdwn of the downstream side air-fuel ratio sensor 41 becomes a value larger than the rich judged air-fuel ratio AFrich. That is, the output air-fuel ratio AFdwn of the downstream side air-fuel ratio sensor 41 becomes substantially the stoichiometric air-fuel ratio. This means that the oxygen storage amount OSA of the upstream side exhaust purification catalyst 20 becomes greater to a certain extent.

Therefore, in the present embodiment, when the output air-fuel ratio AFdwn of the downstream side air-fuel ratio sensor 41 changes to a value larger than the rich judged air-fuel ratio AFrich, the target air-fuel ratio AFT is switched to a slight lean set air-fuel ratio AFTsl. Therefore, at the time $t_3$, the lean degree of the target air-fuel ratio is decreased. Below, the time $t_3$ is called the "lean degree change timing".

At the lean degree change timing of the time $t_3$, if the target air-fuel ratio AFT is switched to the slight lean set air-fuel ratio AFTsl, the lean degree of the exhaust gas flowing into the upstream side exhaust purification catalyst 20 also becomes smaller. Along with this, the output air-fuel ratio AFup of the upstream side air-fuel ratio sensor 40 becomes smaller and the speed of increase of the oxygen storage amount OSA of the upstream side exhaust purification catalyst 20 falls.

After the time $t_3$, the oxygen storage amount OSA of the upstream side exhaust purification catalyst 20 gradually increases, though the speed of increase is slow. If the oxygen storage amount OSA of the upstream side exhaust purification catalyst 20 gradually increases, the oxygen storage amount OSA finally approaches the maximum storable oxygen amount Cmax (for example, Cuplim of FIG. 2). If, at the time $t_4$, the oxygen storage amount OSA approaches the maximum storable oxygen amount Cmax, part of the oxygen flowing into the upstream side exhaust purification catalyst 20 starts to flow out without being stored in the upstream side exhaust purification catalyst 20. Due to this, the output air-fuel ratio AFdwn of the downstream side air-fuel ratio sensor 41 gradually rises. As a result, in the illustrated example, at the time $t_5$, the oxygen storage amount OSA reaches the maximum storable oxygen amount Cmax and the output air-fuel ratio AFdwn of the downstream side air-fuel ratio sensor 41 reaches the lean judged air-fuel ratio AFlean.

In the present embodiment, if the output air-fuel ratio AFdwn of the downstream side air-fuel ratio sensor 41 becomes the lean judged air-fuel ratio AFlean or more, the target air-fuel ratio AFT is switched to the rich set air-fuel ratio AFTr so as to make the oxygen storage amount OSA decrease. Therefore, the target air-fuel ratio is switched from the lean air-fuel ratio to the rich air-fuel ratio.

If, at the time $t_5$, the target air-fuel ratio is switched to the rich air-fuel ratio, the air-fuel ratio of the exhaust gas flowing into the upstream side exhaust purification catalyst 20 changes from the lean air-fuel ratio to the rich air-fuel ratio. Further, along with this, the output air-fuel ratio AFup of the upstream side air-fuel ratio sensor 40 becomes the rich air-fuel ratio (in actuality, a delay occurs from when switching the target air-fuel ratio to when the air-fuel ratio of the exhaust gas flowing into the upstream side exhaust purification catalyst 20 changes, but in the illustrated example, for convenience, it is assumed that they change simultaneously). If, at the time $t_5$, the air-fuel ratio of the exhaust gas flowing into the upstream side exhaust purification catalyst 20 changes to the rich air-fuel ratio, the oxygen storage amount OSA of the upstream side exhaust purification catalyst 20 decreases.

If, in this way, the oxygen storage amount OSA of the upstream side exhaust purification catalyst 20 decreases, the air-fuel ratio of the exhaust gas flowing out from the upstream side exhaust purification catalyst 20 changes toward the stoichiometric air-fuel ratio. In the example shown in FIG. 5, at the time $t_6$, the output air-fuel ratio AFdwn of the downstream side air-fuel ratio sensor 41 becomes a value smaller than the lean judged air-fuel ratio AFlean. That is, the output air-fuel ratio AFdwn of the downstream side air-fuel ratio sensor 41 becomes substantially the stoichiometric air-fuel ratio. This means that the oxygen storage amount OSA of the upstream side exhaust purification catalyst 20 becomes smaller to a certain extent.

Therefore, in the present embodiment, when the output air-fuel ratio AFdwn of the downstream side air-fuel ratio sensor 41 changes to a value smaller than the lean judged air-fuel ratio AFlean, the target air-fuel ratio AFT is switched from the rich set air-fuel ratio to a slight rich set air-fuel ratio AFTsr.

If, at the time $t_6$, the target air-fuel ratio AFT is switched to the slight rich set air-fuel ratio AFTsr, the rich degree of the air-fuel ratio of the exhaust gas flowing into the upstream side exhaust purification catalyst 20 also becomes smaller. Along with this, the output air-fuel ratio AFup of the upstream side air-fuel ratio sensor 40 increases and the speed of decrease of the oxygen storage amount OSA of the upstream side exhaust purification catalyst 20 falls.

After the time $t_6$, the oxygen storage amount OSA of the upstream side exhaust purification catalyst 20 gradually decreases, through the speed of decrease is slow. If the oxygen storage amount OSA of the upstream side exhaust purification catalyst 20 gradually decreases, the oxygen storage amount OSA finally approaches zero at the time $t_7$ in the same way as the time $t_1$ and falls to the Cdwnlim of FIG. 2. Then, at the time $t_8$, in the same way as the time $t_2$, the output air-fuel ratio AFdwn of the downstream side air-fuel ratio sensor 41 reaches the rich judged air-fuel ratio AFrich. Then, an operation similar to the operation from the time $t_1$ to the time $t_6$ is repeated.

Advantages in Basic Control, etc.

According to the above-mentioned basic air-fuel ratio control, at the time right after the time $t_2$ when the target air-fuel ratio is changed from the rich air-fuel ratio to the lean air-fuel ratio, and at the time right after the time $t_5$ when the target air-fuel ratio is changed from the lean air-fuel ratio to the rich air-fuel ratio, the difference between the target air-fuel ratio and the stoichiometric air-fuel ratio is large (that is, the rich degree or lean degree is large). For this reason, it is possible to make the unburned gas which flowed out from the upstream side exhaust purification catalyst 20 at the time $t_2$ and the $NO_x$ which flowed out from the upstream side exhaust purification catalyst 20 at the time $t_5$ rapidly decrease. Therefore, it is possible to suppress the outflow of the unburned gas and $NO_x$ from the upstream side exhaust purification catalyst 20.

Further, according to the air-fuel ratio control of the present embodiment, at the time $t_2$, the target air-fuel ratio is set to the lean set air-fuel ratio, and then after the outflow of unburned gas from the upstream side exhaust purification catalyst 20 is stopped and the oxygen storage amount OSA thereof recovers to a certain extent, the target air-fuel ratio is switched to the slight lean set air-fuel ratio at the time $t_3$. By making the rich degree (difference from stoichiometric air-fuel ratio) of the target air-fuel ratio small in this way, even if $NO_x$ flows out from the upstream side exhaust purification catalyst 20, the amount of outflow per unit time can be decreased. In particular, according to the above air-fuel ratio control, although $NO_x$ flows out from the upstream side exhaust purification catalyst 20 at the time $t_5$, it is possible to keep the amount of outflow at this time small.

In addition, according to the air-fuel ratio control of the present embodiment, at the time $t_5$, the target air-fuel ratio is set to the rich set air-fuel ratio, and then after the outflow of $NO_x$ (oxygen) from the upstream side exhaust purification catalyst 20 stops and the oxygen storage amount OSA thereof decreases by a certain extent, the target air-fuel ratio is switched to the slight rich set air-fuel ratio at the time $t_6$. By making the rich degree of the target air-fuel ratio (difference from stoichiometric air-fuel ratio) smaller in this way, even if unburned gas flows out from the upstream side exhaust purification catalyst 20, it is possible to decrease the amount of outflow per unit time. In particular, according to the above air-fuel ratio control, although unburned gas flows out from the upstream side exhaust purification catalyst 20 at the times $t_2$ and $t_8$, at this time as well, the amount of outflow thereof can be kept small.

Furthermore, in the present embodiment, as the sensor for detecting the air-fuel ratio of the exhaust gas at the downstream side, the air-fuel ratio sensor 41 is used. This air-fuel ratio sensor 41, unlike an oxygen sensor, does not have hysteresis. For this reason, according to the air-fuel ratio sensor 41, which has a high response with respect to the actual exhaust air-fuel ratio, it is possible to quickly detect the outflow of unburned gas and oxygen (and $NO_x$) from the upstream side exhaust purification catalyst 20. Therefore, by this as well, according to the present embodiment, it is possible to suppress the outflow of unburned gas and $NO_x$ (and oxygen) from the upstream side exhaust purification catalyst 20.

Further, in an exhaust purification catalyst which can store oxygen, if maintaining the oxygen storage amount substantially constant, a drop in the oxygen storage capacity will be invited. Therefore, to maintain the oxygen storage capacity as much as possible, at the time of use of the exhaust purification catalyst, it is necessary to make the oxygen storage amount change up and down. According to the air-fuel ratio control according to the present embodiment, the oxygen storage amount OSA of the upstream side exhaust purification catalyst 20 repeatedly changes up and down between near zero and near the maximum storable oxygen amount. For this reason, the oxygen storage amount OSA of the upstream side exhaust purification catalyst 20 can be maintained high as much as possible.

Note that, in the above embodiment, when, at the time $t_3$, the output air-fuel ratio AFdwn of the downstream side air-fuel ratio sensor 41 becomes a value larger than the rich judged air-fuel ratio AFrich, the target air-fuel ratio AFT is switched from the lean set air-fuel ratio AFTl to the slight lean set air-fuel ratio AFTsl. Further, in the above embodiment, when, at the time $t_6$, the output air-fuel ratio AFdwn of the downstream side air-fuel ratio sensor 41 becomes a value smaller than the lean judged air-fuel ratio AFlean, the target air-fuel ratio AFT is switched from the rich set air-fuel ratio AFTr to the slight rich set air-fuel ratio AFTsr. However, the timings for switching the target air-fuel ratio AFT do not necessarily have to be determined based on the output air-fuel ratio AFdwn of the downstream side air-fuel ratio sensor 41 and may also be determined based on other parameters.

For example, the timings for switching the target air-fuel ratio AFT may also be determined based on the oxygen storage amount OSA of the upstream side exhaust purification catalyst 20. For example, as shown in FIG. 5, when, after the target air-fuel ratio is switched to the lean air-fuel ratio at the time $t_2$, the oxygen storage amount OSA of the upstream side exhaust purification catalyst 20 reaches the predetermined amount α, the target air-fuel ratio AFT is switched to the slight lean set correction amount AFTsl. Further, when, after the target air-fuel ratio is switched to the rich air-fuel ratio at the time $t_5$, the oxygen storage amount OSA of the upstream side exhaust purification catalyst 20 is decreased by a predetermined amount α, the target air-fuel ratio AFT is switched to the slight rich set correction amount AFTsr.

In this case, the oxygen storage amount OSA of the upstream side exhaust purification catalyst 20 is estimated based on the cumulative oxygen excess/deficiency of exhaust gas flowing into the upstream side exhaust purification catalyst 20. The "oxygen excess/deficiency" means the oxygen which becomes in excess or the oxygen which becomes deficient (amount of excessive unburned gas, etc.) when trying to make the air-fuel ratio of the exhaust gas flowing into the upstream side exhaust purification catalyst 20 the stoichiometric air-fuel ratio. In particular, when the target air-fuel ratio becomes the lean set air-fuel ratio, the exhaust gas flowing into the upstream side exhaust purification catalyst 20 becomes excessive. This excess oxygen is stored in the upstream side exhaust purification catalyst 20. Therefore, the cumulative value of the oxygen excess/deficiency (below, referred to as "cumulative oxygen excess/deficiency") can be said to express the oxygen storage amount OSA of the upstream side exhaust purification catalyst 20. As shown in FIG. 5, in the present embodiment, the cumulative oxygen excess/deficiency ΣOED is reset to zero when the target air-fuel ratio changes over the stoichiometric air-fuel ratio.

Note that, the oxygen excess/deficiency is calculated based on the output air-fuel ratio AFup of the upstream side air-fuel ratio sensor 40 and the estimated value of the amount of intake air into the combustion chamber 5 which is calculated based on the air flow meter 39, etc., or the amount of feed of fuel from the fuel injector 11, etc. Specifically, the oxygen excess/deficiency OED is, for example, calculated by the following formula (1):

$$OEF=0.23\cdot Qi\cdot(Afup-14.6) \quad (1)$$

Here, 0.23 is the oxygen concentration in the air, Qi indicates the fuel injection amount, and AFup indicates the output air-fuel ratio of the upstream side air-fuel ratio sensor 40.

Alternatively, the timing (lean degree change timing) of switching the target air-fuel ratio AFT to the slight lean set air-fuel ratio AFTsl may be determined based on the elapsed time or the cumulative amount of intake air, etc., from when switching the target air-fuel ratio to the lean air-fuel ratio (time $t_2$). Similarly, the timing of switching the target air-fuel ratio AFT to the slight rich set air-fuel ratio AFCsr (rich degree change timing) may be determined based on the elapsed time or the cumulative amount of intake air, etc., from when switching the target air-fuel ratio to the rich air-fuel ratio (time $t_5$).

In this way, the rich degree change timing or lean degree change timing is determined based on various parameters. Whatever the case, the lean degree change timing is set to a timing after the target air-fuel ratio is set to the lean set air-fuel ratio and before the output air-fuel ratio AFdwn of the downstream side air-fuel ratio sensor 41 becomes the lean judged air-fuel ratio or more. Similarly, the rich degree change timing is set to a timing after the target air-fuel ratio is set to the rich set air-fuel ratio and before the output air-fuel ratio AFdwn of the downstream side air-fuel ratio sensor 41 becomes the rich judged air-fuel ratio or less.

Further, in the above embodiment, from the time $t_2$ to the time $t_3$, the target air-fuel ratio AFT is maintained constant at the lean set air-fuel ratio AFTl. However, during this time period, the target air-fuel ratio AFT need not necessarily be maintained constant and, for example, may also change so as to gradually fall (approach the stoichiometric air-fuel ratio). Similarly, in the above embodiment, from the time $t_3$ to the time $t_5$, the target air-fuel ratio correction amount AFT is maintained constant at the slight lean set air-fuel ratio AFTl. However, during this time period, the target air-fuel ratio AFT does not necessarily have to be maintained constant. For example, it may also change so as to gradually fall (approach the stoichiometric air-fuel ratio). Further, the same can be said for the times $t_5$ to $t_6$ and the times $t_6$ to $t_8$.

Relationship Between Amount of Intake Air and Purifiable Amount

In this regard, the amount of flow of exhaust gas flowing through the upstream side exhaust purification catalyst 20 changes in accordance with the amount of intake air to the combustion chamber 5. Further, if the flow amount of exhaust gas flowing through the upstream side exhaust purification catalyst 20 increases, along with this, the flow rate of exhaust gas when flowing through the upstream side exhaust purification catalyst 20 becomes faster. In this way, if the flow rate of exhaust gas becomes faster, the time, during which the exhaust gas can contact the precious metal which is carried at the upstream side exhaust purification catalyst 20, becomes shorter. Therefore, the faster the flow rate of the exhaust gas, the less the amount of $NO_x$ or the amount of unburned gas which can be purified from the exhaust gas (these together being referred to as the "purifiable amount") while a unit volume of exhaust gas is flowing through the upstream side exhaust purification catalyst 20.

Figure 6:
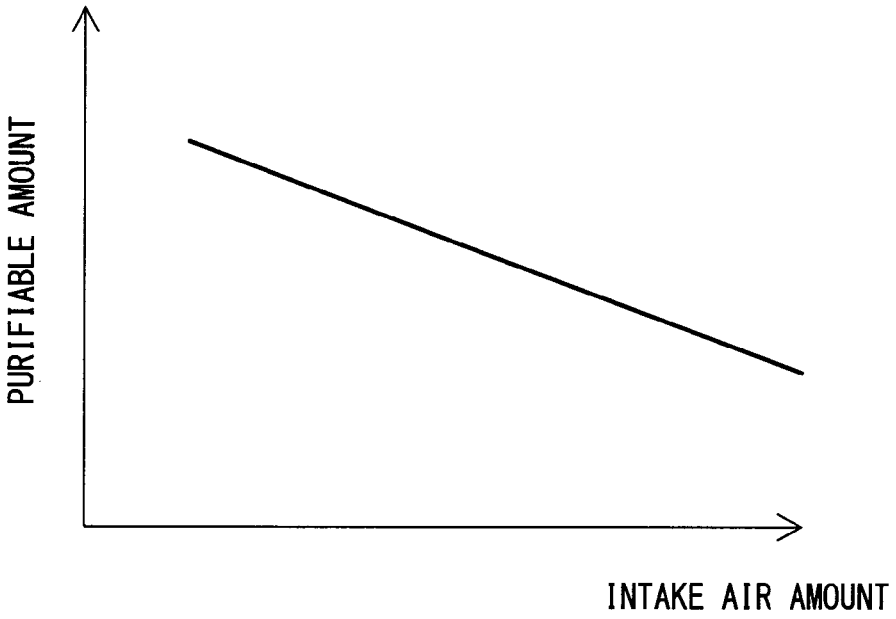
FIG. 6 is a view which shows a relationship between an amount of intake air to a combustion chamber and a purifiable amount in the upstream side exhaust purification catalyst 20.

This state is shown in FIG. 6. FIG. 6 is a view which shows a relationship between an amount of intake air to the combustion chamber 5 and a purifiable amount in the upstream side exhaust purification catalyst 20. As will be understood from FIG. 6, the larger the amount of intake air to the combustion chamber 5, that is, the faster the flow rate of exhaust gas flowing through the upstream side exhaust purification catalyst 20, the more the removable amount of $NO_x$ or unburned gas at the upstream side exhaust purification catalyst 20 is decreased.

As a result, for example, when the amount of flow of exhaust gas flowing through the upstream side exhaust purification catalyst 20 is large and the air-fuel ratio is rich with a large rich degree, exhaust gas containing unpurified unburned gas flows out from the upstream side exhaust purification catalyst 20. Similarly, for example, when the flow amount of exhaust gas flowing through the upstream side exhaust purification catalyst 20 is large and the air-fuel ratio is lean with a large lean degree, exhaust gas containing unpurified $NO_x$ flows out from the upstream side exhaust purification catalyst 20. Therefore, from the viewpoint of purifying the $NO_x$ or unburned gas which is contained in the exhaust gas, it is necessary to make the rich degree or lean degree of the air-fuel ratio of the exhaust gas smaller, the larger the flow amount of exhaust gas flowing through the upstream side exhaust purification catalyst 20.

Control of Target Air-Fuel Ratio in Present Embodiment

Figure 7:
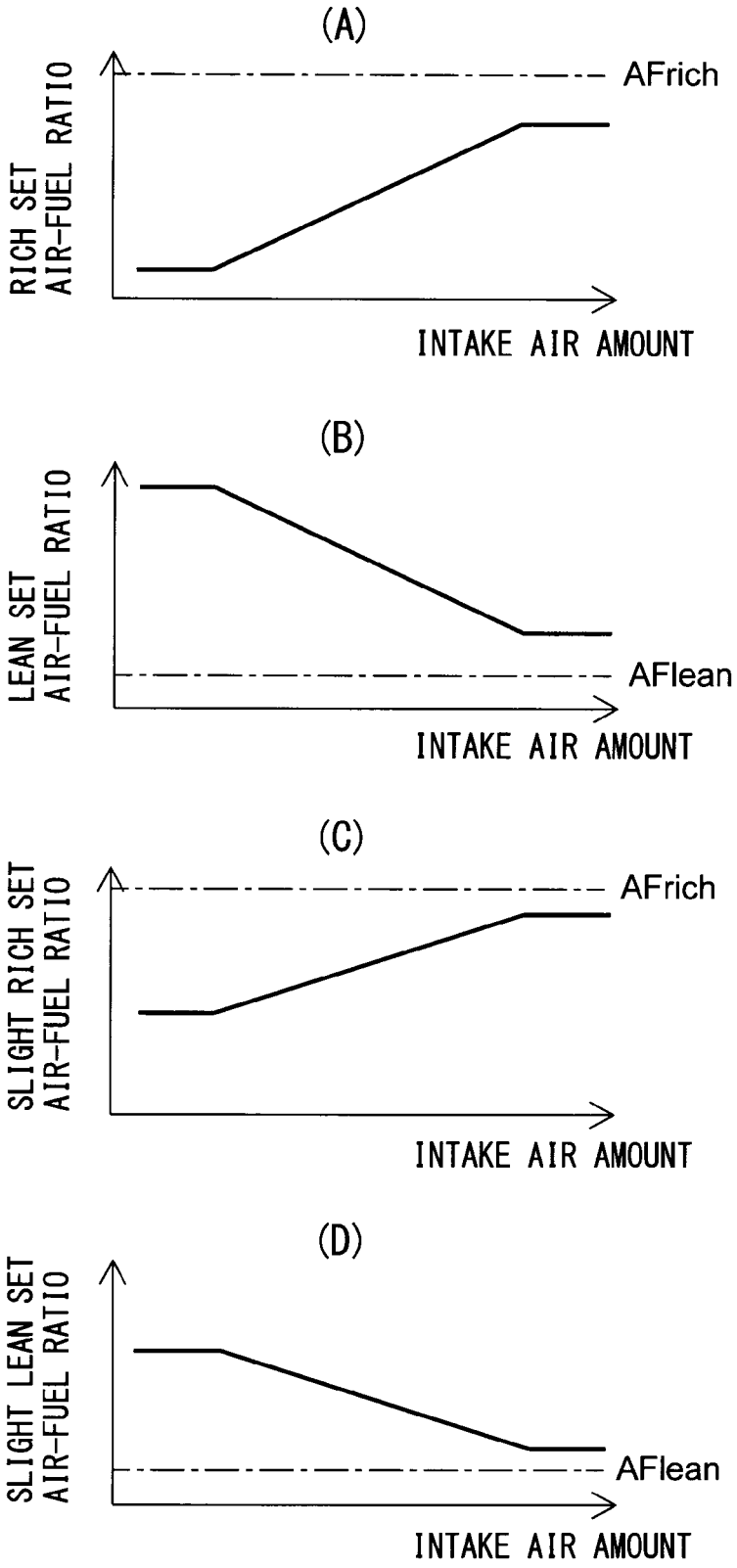
FIG. 7 is a view which shows a relationship between an amount of intake air and a rich set air-fuel ratio, etc.

Therefore, in the present embodiment, the rich degree of the rich set air-fuel ratio AFTr and the lean degree of the lean set air-fuel ratio AFTl are changed in accordance with the amount of intake air to the combustion chamber 5, that is, the amount of flow of exhaust gas flowing through the upstream side exhaust purification catalyst 20. Specifically, as shown in FIG. 7(A), the rich set air-fuel ratio AFTr is changed so as to become larger, that is, to become smaller in rich degree, the more the amount of intake air increases. However, the rich set air-fuel ratio AFTr is always set to a value smaller than the rich judged air-fuel ratio AFrich, regardless of the amount of intake air. Further, in the example shown in FIG. 7(A), in the region where the amount of intake air is smaller than a certain constant amount, the rich set air-fuel ratio AFTr is set to a constant value. Similarly, in the region where the amount of intake air is a certain constant amount or more, the rich set air-fuel ratio AFTr is set to a constant value.

Further, in the present embodiment, as shown in FIG. 7(B), the lean set air-fuel ratio AFTl is changed to become smaller, that is, to become smaller in lean degree, the more the amount of intake air increases. However, the lean set air-fuel ratio AFTl is always set to a value larger than the lean judged air-fuel ratio AFlean, regardless of the amount of intake air. Further, in the example shown in FIG. 7(B), in the region where the amount of intake air is smaller than a certain constant amount, the lean set air-fuel ratio AFTl is set to a constant value. Similarly, in the region where the amount of intake air is a certain constant amount or more, the lean set air-fuel ratio AFTl is set to a constant value.

Figure 8:
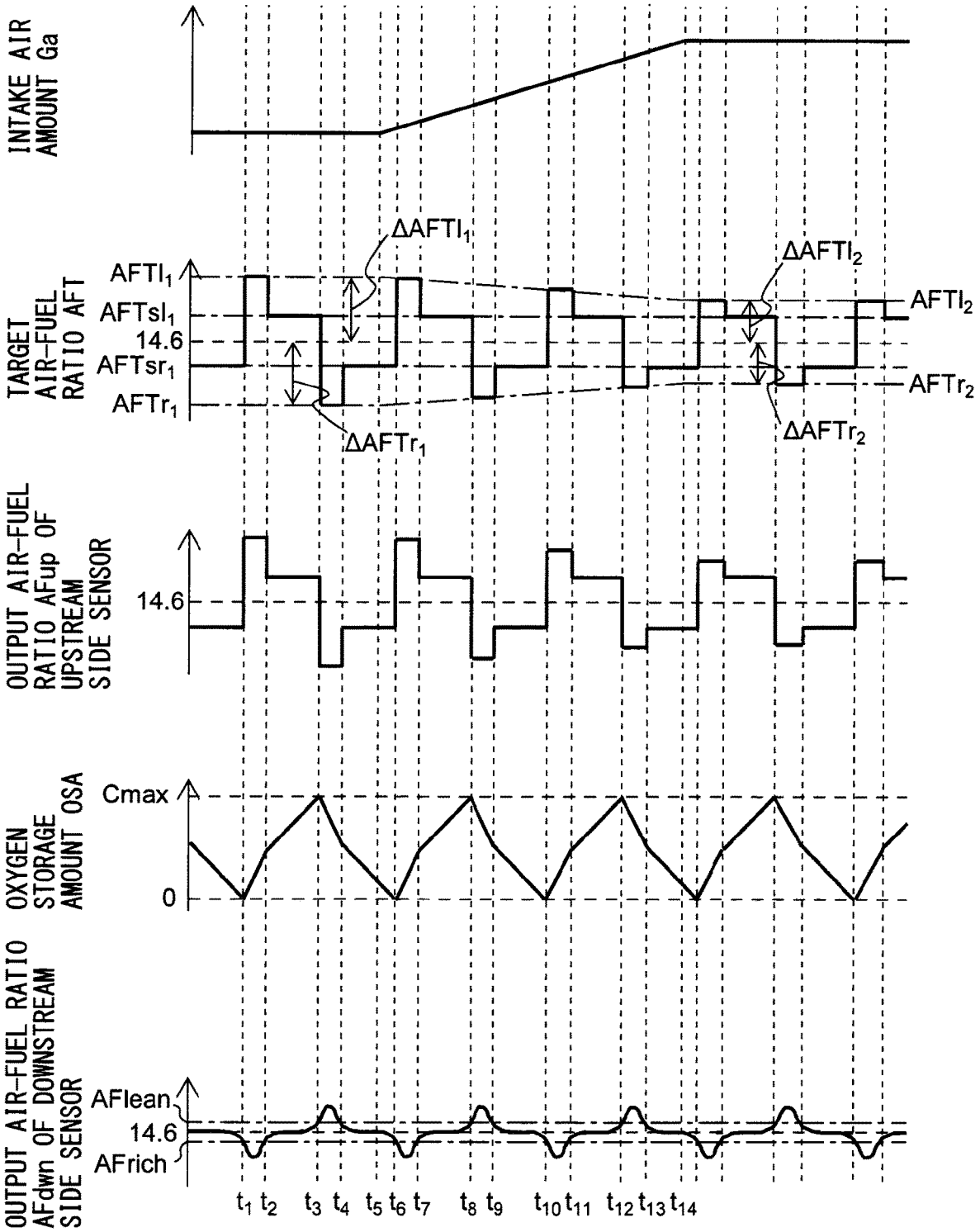
FIG. 8 is a time chart of a target air-fuel ratio, etc., when changing a rich set air-fuel ratio and lean set air-fuel ratio according to the first embodiment.

FIG. 8 is a time chart of the target air-fuel ratio AFT, etc., when changing the rich set air-fuel ratio AFTr and lean set air-fuel ratio AFTl according to the present embodiment. In the example shown in FIG. 8 as well, basically, air-fuel ratio control similar to FIG. 5 is performed.

In the example shown in FIG. 8, before the time $t_5$, the amount of intake air Ga is maintained substantially constant at a relatively small amount. The lean set air-fuel ratio AFTl and rich set air-fuel ratio AFTr at this time are respectively set to the first lean set air-fuel ratio $AFTl_1$ and the first rich set air-fuel ratio $AFTr_1$. In this regard, the difference between the first lean set air-fuel ratio $AFTl_1$ and the stoichiometric air-fuel ratio is the first lean degree $\Delta AFTl_1$. Further, the difference between the first rich set air-fuel ratio $AFTr_1$ and the stoichiometric air-fuel ratio is the first rich degree $\Delta AFTr_1$.

Therefore, if, at the time $t_1$, the output air-fuel ratio AFdwn of the downstream side air-fuel ratio sensor 41 becomes the rich judged air-fuel ratio AFrich or less, the target air-fuel ratio AFT is switched to the first lean set air-fuel ratio $AFTl_1$. Further, if, at the time $t_3$, the output air-fuel ratio AFdwn of the downstream side air-fuel ratio sensor 41 becomes the lean judged air-fuel ratio AFlean or more, the target air-fuel ratio AFT is switched to the first rich set air-fuel ratio $AFTr_1$. This cycle is repeated up to the time $t_5$.

In the example shown in FIG. 8, after the time $t_5$, the amount of intake air Ga is gradually increased. Along with this, based on the maps shown in FIG. 7(A) and FIG. 7(B), the lean set air-fuel ratio AFTl is gradually decreased (lean degree is made smaller) and the rich set air-fuel ratio AFTr is gradually increased (rich degree is made smaller). Therefore, at the time $t_6$, if the output air-fuel ratio AFdwn of the downstream side air-fuel ratio sensor 41 becomes the rich judged air-fuel ratio AFrich or less, the target air-fuel ratio AFT is set to the lean air-fuel ratio with a smaller lean degree than the first lean set air-fuel ratio $AFTl_1$. In addition, at the time $t_{10}$, if the output air-fuel ratio AFdwn of the downstream side air-fuel ratio sensor 41 becomes the rich judged air-fuel ratio AFrich or less, the target air-fuel ratio is set to a lean air-fuel ratio with a further smaller lean degree than the first lean set air-fuel ratio $AFTl_1$.

Similarly, if, at the time $t_8$, the output air-fuel ratio AFdwn of the downstream side air-fuel ratio sensor 41 becomes the lean judged air-fuel ratio AFlean or more, the target air-fuel ratio AFT is set to a rich air-fuel ratio with a smaller rich degree than the first rich set air-fuel ratio $AFTr_1$. In addition, if, at the time $t_{12}$, the output air-fuel ratio AFdwn of the downstream side air-fuel ratio sensor 41 becomes the lean judged air-fuel ratio or more, the target air-fuel ratio AFT is set to a rich air-fuel ratio with a further smaller rich degree than the first rich set air-fuel ratio $AFTr_1$.

In the example shown in FIG. 8, up to the time $t_{14}$, the amount of intake air Ga continues to increase. After the time $t_{14}$, the amount of intake air Ga is maintained substantially constant at a relatively large amount. The lean set air-fuel ratio AFTl at this time is set to a second lean set air-fuel ratio $AFTl_2$ which is smaller than the first lean set air-fuel ratio $AFTl_1$. In this regard, the difference between the second lean set air-fuel ratio $AFTl_2$ and the stoichiometric air-fuel ratio is the second lean degree $\Delta AFTl_2$, which is smaller than the first lean degree $\Delta AFTl_1$. On the other hand, the rich set air-fuel ratio AFTr at this time is set to a second rich set air-fuel ratio $AFTr_2$ which is larger than the first rich set air-fuel ratio $AFTr_1$. In this regard, the difference between the second rich set air-fuel ratio $AFTr_2$ and the stoichiometric air-fuel ratio becomes a second rich degree $\Delta AFTr_2$, which is smaller than the first rich degree $\Delta AFTr_1$.

Further, in the present embodiment, even if the amount of intake air changes, neither of the slight lean set air-fuel ratio AFTsl and the slight rich set air-fuel ratio AFTsr are changed. Therefore, in the example shown in FIG. 8, both the slight lean set air-fuel ratio AFTsl and the slight rich set air-fuel ratio AFTsr are maintained at the first slight lean set air-fuel ratio $AFTsl_1$ and the first slight rich set air-fuel ratio $AFTsr_1$. In addition, in the present embodiment, the lean set air-fuel ratio AFTl is set to the slight lean set air-fuel ratio AFTsl or more even when the amount of intake air is large. Further, the rich set air-fuel ratio AFTr is set to the slight rich set air-fuel ratio AFTsr or less even when the amount of intake air is large.

In this regard, the lean set air-fuel ratio AFTl is larger in lean degree than the slight lean set air-fuel ratio AFTsl, and therefore when the amount of intake air increases, the $NO_x$ in the exhaust gas easily flows out without being purified at the upstream side exhaust purification catalyst 20. Further, the rich set air-fuel ratio AFTr is larger in rich degree than the slight rich set air-fuel ratio AFTsr, and therefore when the amount of intake air increases, the unburned gas in the exhaust gas easily flows out without being purified at the upstream side exhaust purification catalyst 20. According to the present embodiment, the larger the amount of intake air to the combustion chamber 5, the more the lean degree of the lean set air-fuel ratio AFTl and the rich degree of the rich set air-fuel ratio AFTr can be decreased. Therefore, it is possible to effectively suppress the outflow of $NO_x$ or unburned gas from the upstream side exhaust purification catalyst 20.

Note that, in the above embodiment, both the lean set air-fuel ratio AFTl and the rich set air-fuel ratio AFTr are changed in accordance with the amount of intake air. However, it is also possible to change only one of the lean set air-fuel ratio AFTl and the rich set air-fuel ratio AFTr in accordance with the amount of intake air and maintain the other constant as it is.

Further, in the above embodiment, as the parameter which expresses the flow rate of exhaust gas flowing through the upstream side exhaust purification catalyst 20, the amount of intake air to the combustion chamber 5 is used, and the lean set air-fuel ratio AFTl, etc., is changed based on the amount of intake air. However, the flow rate of the exhaust gas flowing through the upstream side exhaust purification catalyst 20 may be calculated based on other parameters as well. Therefore, for example, the flow rate of the exhaust gas may be calculated based on the engine load and engine speed, and in this case, the lean set air-fuel ratio AFTl, etc., is changed based on the engine load and engine speed.

Flow Chart

Figure 9:
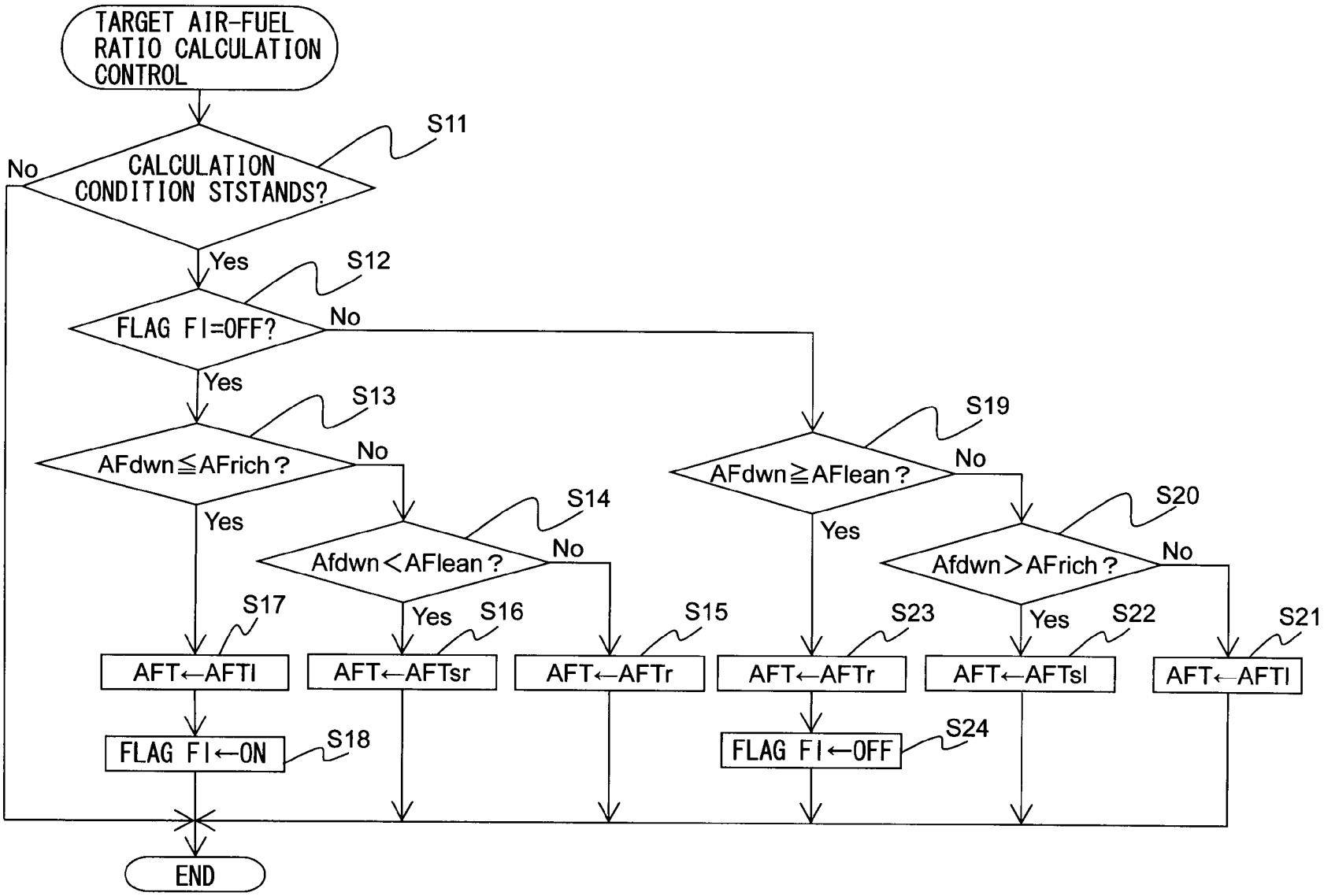
FIG. 9 is a flow chart which shows a control routine in control for setting a target air-fuel ratio.

FIG. 9 is a flow chart which shows the control routine in control for setting the target air-fuel ratio. The illustrated control routine is performed by interruption at fixed time intervals.

As shown in FIG. 9, first, at step S11, it is judged if the condition for calculation of the target air-fuel ratio AFT stands. The case where the condition for calculation of the target air-fuel ratio AFT stands means a case such as during normal control, for example, not during fuel cut control, etc. When it is judged at step S11 that the condition for calculation of the target air-fuel ratio AFT stands, the routine proceeds to step S12.

At step S12, it is judged if the lean set flag Fl is set to OFF. The lean set flag Fl is a flag which is set to ON when the target air-fuel ratio is set to the lean air-fuel ratio, and is set to OFF otherwise. When it is judged at step S12 that the lean set flag Fl is set to OFF, the routine proceeds to step S13. At step S13, it is judged if the output air-fuel ratio AFdwn of the downstream side air-fuel ratio sensor 41 is the rich judged air-fuel ratio AFrich or less.

When, at step S13, it is judged that the output air-fuel ratio AFdwn of the downstream side air-fuel ratio sensor 41 is larger than the rich judged air-fuel ratio AFrich, the routine proceeds to step S14. At step S14, it is judged if the output air-fuel ratio AFdwn of the downstream side air-fuel ratio sensor 41 is smaller than the lean judged air-fuel ratio AFlean. When it is judged that the output air-fuel ratio AFdwn is the lean judged air-fuel ratio AFlean or more, the routine proceeds to step S15. At step S15, the target air-fuel ratio AFT is set to the rich set air-fuel ratio AFTr and the control routine is ended.

Then, if the output air-fuel ratio AFdwn of the downstream side air-fuel ratio sensor 41 approaches the stoichiometric air-fuel ratio and becomes smaller than the lean judged air-fuel ratio AFlean, at the next control routine, the routine proceeds from step S14 to step S16. At step S16, the target air-fuel ratio AFT is set to the slight rich set air-fuel ratio AFTsr and the control routine is ended.

Then, if the oxygen storage amount OSA of the upstream side exhaust purification catalyst 20 becomes substantially zero and the output air-fuel ratio AFdwn of the downstream side air-fuel ratio sensor 41 becomes the rich judged air-fuel ratio AFrich or less, at the next control routine, the routine proceeds from step S13 to step S17. At step S17, the target air-fuel ratio AFT is set to the lean set air-fuel ratio AFTl. Next, at step S18, the lean set flag Fl is set to ON and the control routine is ended.

If the lean set flag Fl is set to ON, at the next control routine, the routine proceeds from step S12 to step S19. At step S19, it is judged if the output air-fuel ratio AFdwn of the downstream side air-fuel ratio sensor 41 is the lean judged air-fuel ratio AFlean or more.

When it is judged at step S19 that the output air-fuel ratio AFdwn of the downstream side air-fuel ratio sensor 41 is smaller than the lean judged air-fuel ratio AFlean, the routine proceeds to step S20. At step S20, it is judged if the output air-fuel ratio AFdwn of the downstream side air-fuel ratio sensor 41 is larger than the rich judged air-fuel ratio AFrich. If it is judged that the output air-fuel ratio AFdwn is the rich judged air-fuel ratio AFrich or less, the routine proceeds to step S21. At step S21, the target air-fuel ratio AFT is continued to be set to the lean set air-fuel ratio AFTl and the control routine is ended.

Then, if the output air-fuel ratio AFdwn of the downstream side air-fuel ratio sensor 41 approaches the stoichiometric air-fuel ratio and becomes larger than the rich judged air-fuel ratio AFrich, at the next control routine, the routine proceeds from step S20 to step S22. At step S22, the target air-fuel ratio AFT is set to the slight lean set air-fuel ratio AFCsl and the control routine is ended.

Then, if the oxygen storage amount OSA of the upstream side exhaust purification catalyst 20 becomes the substantially maximum storable oxygen amount and the output air-fuel ratio AFdwn of the downstream side air-fuel ratio sensor 41 becomes the lean judged air-fuel ratio AFlean or more, at the next control routine, the routine proceeds from step S19 to step S23. At step S23, the target air-fuel ratio AFT is set to the rich set air-fuel ratio AFTr. Next, at step S24, the lean set flag Fl is reset to OFF and the control routine is ended.

Figure 10:
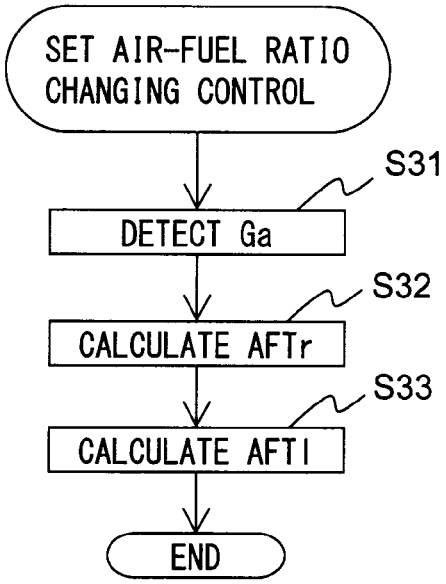
FIG. 10 is a flow chart which shows a control routine in control for changing a rich set air-fuel ratio and a lean set air-fuel ratio.

FIG. 10 is a flow chart which shows a control routine in control for changing the rich set air-fuel ratio and the lean set air-fuel ratio. The illustrated control routine is executed by interruption every certain time interval.

First, at step S31, the amount of intake air to the combustion chamber 5 is calculated by the air flow meter 39. Next, at step S32, the rich set air-fuel ratio AFTr is calculated based on the amount of intake air Ga detected at step S31 by using the map shown in FIG. 7(A). The calculated rich set air-fuel ratio AFTr is used at steps S15 and S23 of FIG. 9. Next, at step S33, the lean set air-fuel ratio AFTl is calculated based on the amount of intake air Ga detected at step S31 by using the map shown in FIG. 7(B) and the control routine is ended. The calculated lean set air-fuel ratio AFTl is used at steps S17 and S21 of FIG. 9.

Modification of First Embodiment

Next, referring to FIGS. 11 and 12, a control system according to a modification of the first embodiment will be explained. In the control system according to the first embodiment, only the lean set air-fuel ratio AFTl and the rich set air-fuel ratio AFTr were changed in accordance with the amount of intake air. In this regard, in the control system according to a modification of the first embodiment, the slight lean set air-fuel ratio AFTsl and the slight rich set air-fuel ratio AFTsr are changed in accordance with the amount of intake air.

Specifically, as shown in FIG. 7(C), the slight rich set air-fuel ratio AFTsr is changed so as to become larger, that is, to become smaller in rich degree, as the amount of intake air increases. However, the slight rich set air-fuel ratio AFTsr is always set to a value which is smaller than the rich judged air-fuel ratio AFrich regardless of the amount of intake air. Further, as will be understood from a comparison with the rich set air-fuel ratio shown in FIG. 7(A), if the amount of intake air is the same, the slight rich set air-fuel ratio AFTsr is set to a value larger than the rich set air-fuel ratio AFTr (a value with a smaller rich degree).

Similarly, in this modification, as shown in FIG. 7(D), the slight lean set air-fuel ratio AFTsl is changed to become smaller, that is, to become smaller in lean degree, as the amount of intake air increases. However, the slight lean set air-fuel ratio AFTsl is always set to a value which is larger than the lean judged air-fuel ratio AFlean regardless of the amount of intake air. Further, as will be understood from a comparison with the lean set air-fuel ratio which is shown in FIG. 7(B), if the amount of intake air is the same, the slight lean set air-fuel ratio AFTsl is set to a value smaller than the lean set air-fuel ratio AFTl (a value with a smaller lean degree).

Figure 11:
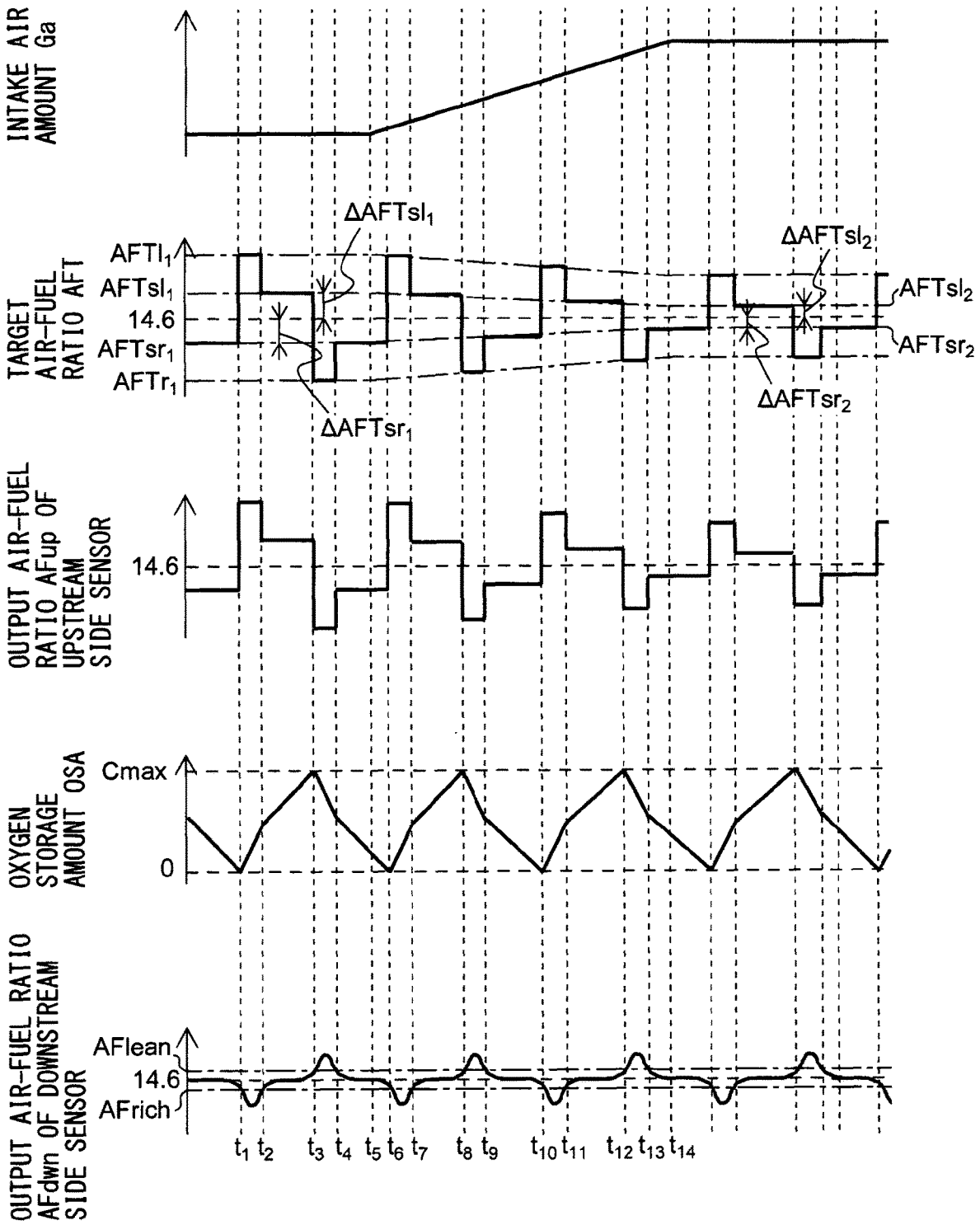
FIG. 11 is a time chart of a target air-fuel ratio, etc., when performing control for changing a lean set air-fuel ratio, etc.

FIG. 11 is a time chart similar to FIG. 8 of the target air-fuel ratio AFT, etc. when changing the rich set air-fuel ratio AFTr, etc., according to the present modification. In the example shown in FIG. 11 as well, before the time $t_5$, the amount of intake air Ga is maintained substantially constant at a relatively small amount. The slight lean set air-fuel ratio AFTsl and the slight rich set air-fuel ratio AFTsr at this time are respectively set to the first slight lean set air-fuel ratio $AFTsl_1$ and the first slight rich set air-fuel ratio $AFTsr_1$. In this regard, the difference between the first slight lean set air-fuel ratio $AFTsl_1$ and the stoichiometric air-fuel ratio is the first lean degree $\Delta AFTsl_1$. Further, the difference between the first slight rich set air-fuel ratio $AFTsr_1$ and the stoichiometric air-fuel ratio is the first rich degree $\Delta AFTsr_1$.

Therefore, if, at the time $t_2$, the output air-fuel ratio AFdwn of the downstream side air-fuel ratio sensor 41 changes from the rich judged air-fuel ratio AFrich or less to an air-fuel ratio larger than the rich judged air-fuel ratio AFrich, the target air-fuel ratio AFT is switched to the first slight lean set air-fuel ratio $AFTsl_1$. Further, if, at the time $t_4$, the output air-fuel ratio AFdwn of the downstream side air-fuel ratio sensor 41 changes from the lean judged air-fuel ratio AFlean or more to an air-fuel ratio which is smaller than the lean judged air-fuel ratio AFlean, the target air-fuel ratio AFT is switched to the first slight rich set air-fuel ratio $AFTsr_1$. Then, this cycle is repeated until the time $t_7$.

In the example shown in FIG. 11, after the time $t_5$, the amount of intake air Ga is gradually increased. Along with this, in the same way as the example shown in FIG. 8, the lean set air-fuel ratio AFTl is decreased and the rich set air-fuel ratio AFTr is increased. In addition, in the example shown in FIG. 11, along with the increase of the amount of intake air Ga, based on the maps shown in FIG. 7(C) and FIG. 7(D), the slight lean set air-fuel ratio AFTsl is gradually decreased (the lean degree is made smaller) and the slight rich set air-fuel ratio AFTsr is gradually increased (the rich degree is made smaller). Therefore, at the time $t_7$, the target air-fuel ratio AFT is set to a lean air-fuel ratio with a smaller lean degree than the first slight lean set air-fuel ratio $AFTsl_1$, and at the time $t_{11}$, the target air-fuel ratio AFT is set to a lean air-fuel ratio with a further smaller lean degree than the first slight lean set air-fuel ratio $AFTsl_1$. Similarly, at the time $t_9$, the target air-fuel ratio AFT is set to a rich air-fuel ratio with a smaller rich degree than the first rich set air-fuel ratio $AFTr_1$. In addition, at the time $t_{13}$, the target air-fuel ratio AFT is set to a rich air-fuel ratio with a further smaller rich degree than the first slight rich set air-fuel ratio $AFTsr_1$.

In the example shown in FIG. 11, in the same way as the example shown in FIG. 8, after the time $t_{14}$, the amount of intake air Ga is maintained substantially constant at a relatively large amount. The slight lean set air-fuel ratio AFTsl at this time is set to a second slight lean set air-fuel ratio $AFTsl_2$ which is smaller than the first slight lean set air-fuel ratio $AFTsl_1$. In this regard, the difference between the second slight lean set air-fuel ratio $AFTsl_2$ and the stoichiometric air-fuel ratio is the second lean degree $\Delta AFTsl_2$ which is smaller than the first lean degree $\Delta AFTsl_1$. On the other hand, the slight rich set air-fuel ratio AFTsr at this time is set to a second slight rich set air-fuel ratio $AFTsr_2$ which is larger than the first slight rich set air-fuel ratio $AFTsr_1$. In this regard, the difference between the second slight rich set air-fuel ratio $AFTsr_2$ and the stoichiometric air-fuel ratio is the second rich degree $\Delta AFTsr_2$ which is smaller than the first rich degree $\Delta AFTsr_1$.

In this regard, the slight lean set air-fuel ratio AFTsl is smaller in lean degree than the lean set air-fuel ratio AFTl. Further, the slight rich set air-fuel ratio AFTsr is also smaller in rich degree than the rich set air-fuel ratio AFTr. However, even if the lean degree or the rich degree is small in this way, when the amount of intake air increases, there is a possibility of the $NO_x$ or the unburned gas flowing out.

Further, if referring to FIG. 5, around the times $t_1$ to $t_3$, it is learned that the output air-fuel ratio AFdwn of the downstream side air-fuel ratio sensor 41 is the rich air-fuel ratio and exhaust gas containing unburned gas flows out from the upstream side exhaust purification catalyst 20. The larger the amount of intake air and the larger the rich degree of the slight rich set air-fuel ratio AFTsr, the greater the unburned gas flowing out at this time becomes. Further, around the times $t_4$ to $t_6$ of FIG. 5, it is learned that the output air-fuel ratio AFdwn of the downstream side air-fuel ratio sensor 41 is the lean air-fuel ratio and exhaust gas containing oxygen and $NO_x$ flows out from the upstream side exhaust purification catalyst 20. The larger the amount of intake air and the larger the lean degree of the slight lean set air-fuel ratio AFTsl, the greater the $NO_x$ flowing out at this time becomes.

In this regard, in the control system of the present modification, the larger the amount of intake air to the combustion chamber 5, the more the lean degree of the slight lean set air-fuel ratio AFTsl and the rich degree of the slight rich set air-fuel ratio AFTsr are lowered. Therefore, it is possible to effectively suppress the outflow of $NO_x$ or unburned gas from the upstream side exhaust purification catalyst 20 when the target air-fuel ratio AFT is set to the slight lean set air-fuel ratio AFTsl or the slight rich set air-fuel ratio AFTsr. In addition, it is possible to suppress the outflow of unburned gas around the times $t_1$ to $t_3$ of FIG. 5 and the outflow of $NO_x$ around the times $t_4$ to $t_6$.

Note that, in the above embodiment and its modification, when the amount of intake air increases, the lean degree of the lean set air-fuel ratio AFTl and the rich degree of the rich set air-fuel ratio AFTr are set smaller. However, as shown in FIG. 12, it is also possible to maintain the lean degree of the lean set air-fuel ratio AFTl and the rich degree of the rich set air-fuel ratio AFTr as they are, even if the amount of intake air increases. In this case, when the amount of intake air increases, the lean degree of the slight lean set air-fuel ratio AFTsl and the rich degree of the slight rich set air-fuel ratio AFTsr are set smaller.

Figure 12:
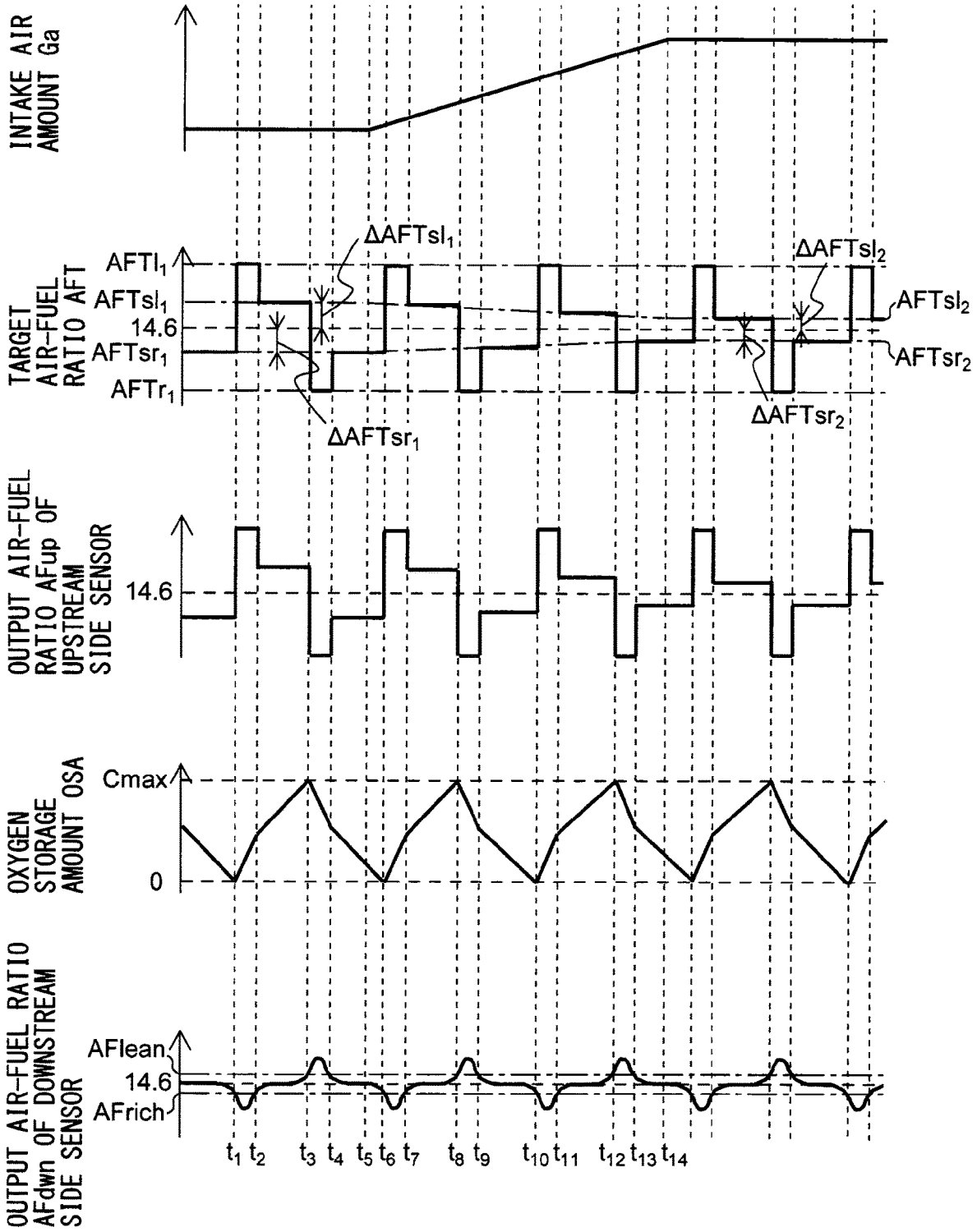
FIG. 12 is a time chart of a target air-fuel ratio, etc., when performing control for changing a slight lean set air-fuel ratio etc.

Further, in the example shown in FIGS. 8, 11 and 12, in the time periods of the times $t_1$ to $t_2$, $t_6$ to $t_7$, $t_{10}$ to $t_{11}$, etc., the target air-fuel ratio AFT is maintained at the constant lean set air-fuel ratio AFTl. However, the lean set air-fuel ratio AFTl need not be constant in these time periods. In this case, the average value of the lean set air-fuel ratio AFTl in the times $t_6$ to $t_7$ is set smaller in lean degree than the average value of the lean set air-fuel ratio AFTl in the times $t_1$ to $t_2$. In addition, the average value of the lean set air-fuel ratio AFTl in the times $t_{10}$ to $t_{11}$ is set further smaller in lean degree than the average value of the lean set air-fuel ratio AFTl in the times $t_1$ to $t_2$. The same may be said for the rich set air-fuel ratio AFTr, slight lean set air-fuel ratio AFTsl, and slight rich set air-fuel ratio AFTsr.

Further, in the above embodiment and its modification, the rich degree is decreased while the target air-fuel ratio AFT is set to the rich air-fuel ratio (for example, at the time $t_6$ of FIG. 5). However, the rich degree may also be maintained constant while the target air-fuel ratio AFT is set to the rich air-fuel ratio (for example, maintained constant at the rich set air-fuel ratio). Similarly, in the above embodiment and its modification, the lean degree is decreased while the target air-fuel ratio AFT is set to the lean air-fuel ratio (for example, at the time $t_3$ of FIG. 5). However, the lean degree may also be maintained constant while the target air-fuel ratio AFT is set to the lean air-fuel ratio (for example, maintained constant at the lean set air-fuel ratio). In this case, if the amount of intake air increases, the rich degree of the rich set air-fuel ratio or the lean degree of the lean set air-fuel ratio is set smaller.

If expressing the above together, in the present embodiment, when the output air-fuel ratio AFdwn of the downstream side air-fuel ratio sensor 41 becomes the rich judged air-fuel ratio AFrich or less, the target air-fuel ratio is set to the lean air-fuel ratio. In addition, when the output air-fuel ratio AFdwn of the downstream side air-fuel ratio sensor 41 becomes the lean judged air-fuel ratio or more, the target air-fuel ratio is set to the rich air-fuel ratio. Further, if the flow rate of the exhaust gas flowing through the upstream side exhaust purification catalyst 20, which is detected or estimated by the flow rate detecting device (for example, the air flow meter 39), is changed to become faster, the lean degree is set lower than before, during at least part of the time period during which the target air-fuel ratio AFT is set to the lean air-fuel ratio, and/or the rich degree is set lower than before, during at least part of the time period during which the target air-fuel ratio AFT is set to the rich air-fuel ratio.

Second Embodiment

Figure 13:
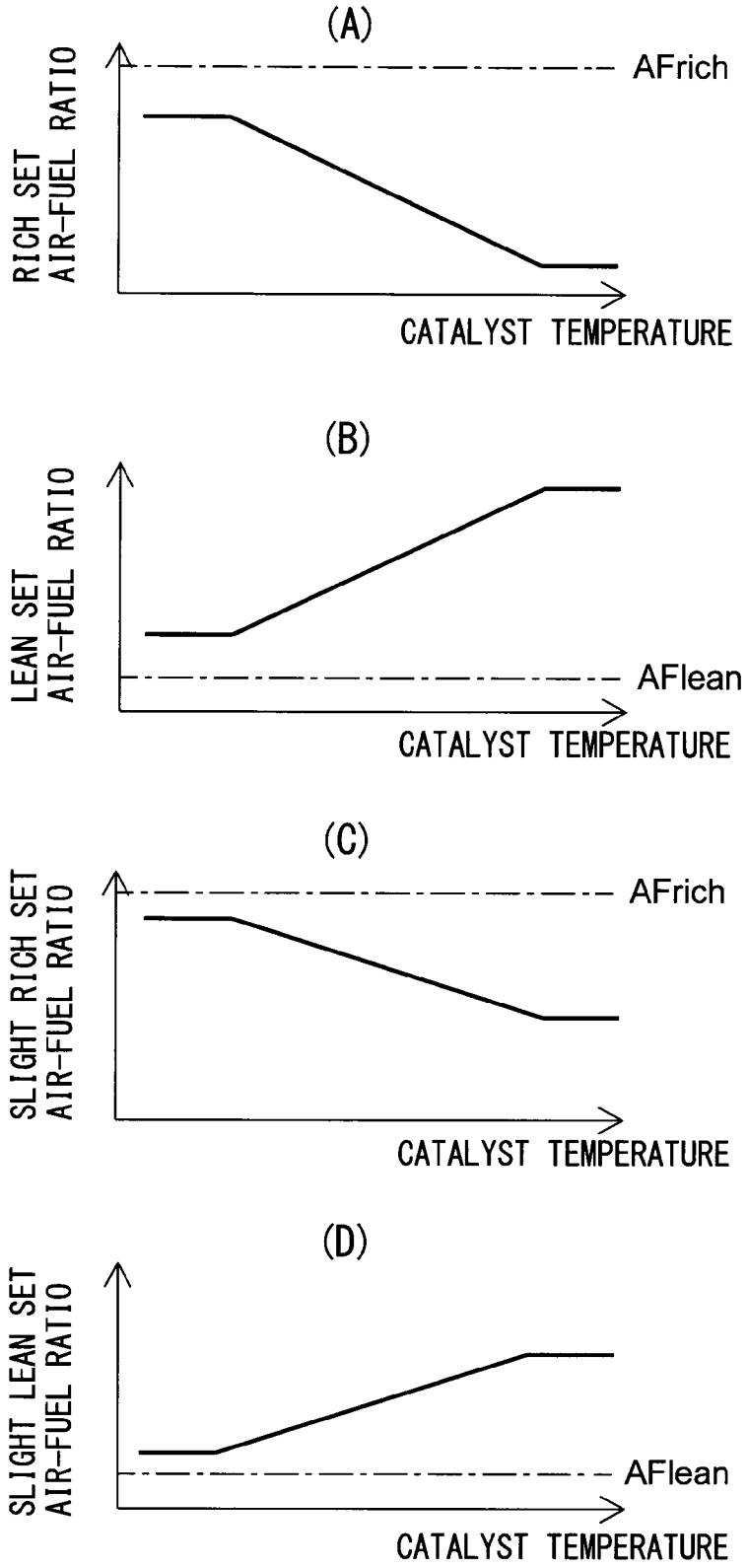
FIG. 13 is a view which shows a relationship between a temperature of an upstream side exhaust purification catalyst and a rich set air-fuel ratio, etc.

Next, referring to FIGS. 13 and 14, a control system according to a second embodiment of the present invention will be explained. The configuration and control of the control system according to the second embodiment are basically similar to the configuration and control of the control system according to the first embodiment. However, in the first embodiment, the rich set air-fuel ratio, etc., is changed based on the amount of intake air, while in the second embodiment, the rich set air-fuel ratio, etc., is changed based on the temperature of the exhaust purification catalyst, etc.

The purification ability of the upstream side exhaust purification catalyst 20 changes according to its temperature. That is, the higher the temperature of the upstream side exhaust purification catalyst 20, the higher the activity of the precious metal which is carried on the upstream side exhaust purification catalyst 20. As a result, the $NO_x$ and unburned gas in the exhaust gas flowing into the upstream side exhaust purification catalyst 20 become easier to be purified. Considered conversely, the lower the temperature of the upstream side exhaust purification catalyst 20, the more the purification rate of $NO_x$ and unburned gas in the exhaust gas flowing into the upstream side exhaust purification catalyst 20 falls.

As a result, for example, when the temperature of the upstream side exhaust purification catalyst 20 is low and the air-fuel ratio of the exhaust gas flowing into the upstream side exhaust purification catalyst 20 is rich with a large rich degree, exhaust gas which contains unpurified unburned gas flows out from the upstream side exhaust purification catalyst 20. Similarly, for example, when the temperature of the upstream side exhaust purification catalyst 20 is low and the air-fuel ratio of the exhaust gas flowing into the upstream side exhaust purification catalyst 20 is lean with a large lean degree, exhaust gas which contains unpurified $NO_x$ flows out from the upstream side exhaust purification catalyst 20. Therefore, from the viewpoint of purifying the $NO_x$ or unburned gas contained in the exhaust gas, it is necessary to make the rich degree or lean degree of the air-fuel ratio of the exhaust gas smaller, as the temperature of the upstream side exhaust purification catalyst 20 becomes lower.

Therefore, in the present embodiment, the rich degree of the rich set air-fuel ratio AFTr and the lean degree of the lean set air-fuel ratio AFTl are changed in accordance with the temperature of the upstream side exhaust purification catalyst 20. Specifically, as shown in FIG. 13(A), the rich set air-fuel ratio AFTr is changed to become smaller, that is, to become larger in rich degree, as the temperature of the upstream side exhaust purification catalyst 20 becomes higher. Similarly, in the present embodiment, as shown in FIG. 13(B), the lean set air-fuel ratio AFTl is changed to become larger, that is, to become larger in lean degree, as the temperature of the upstream side exhaust purification catalyst 20 becomes higher.

Figure 14:
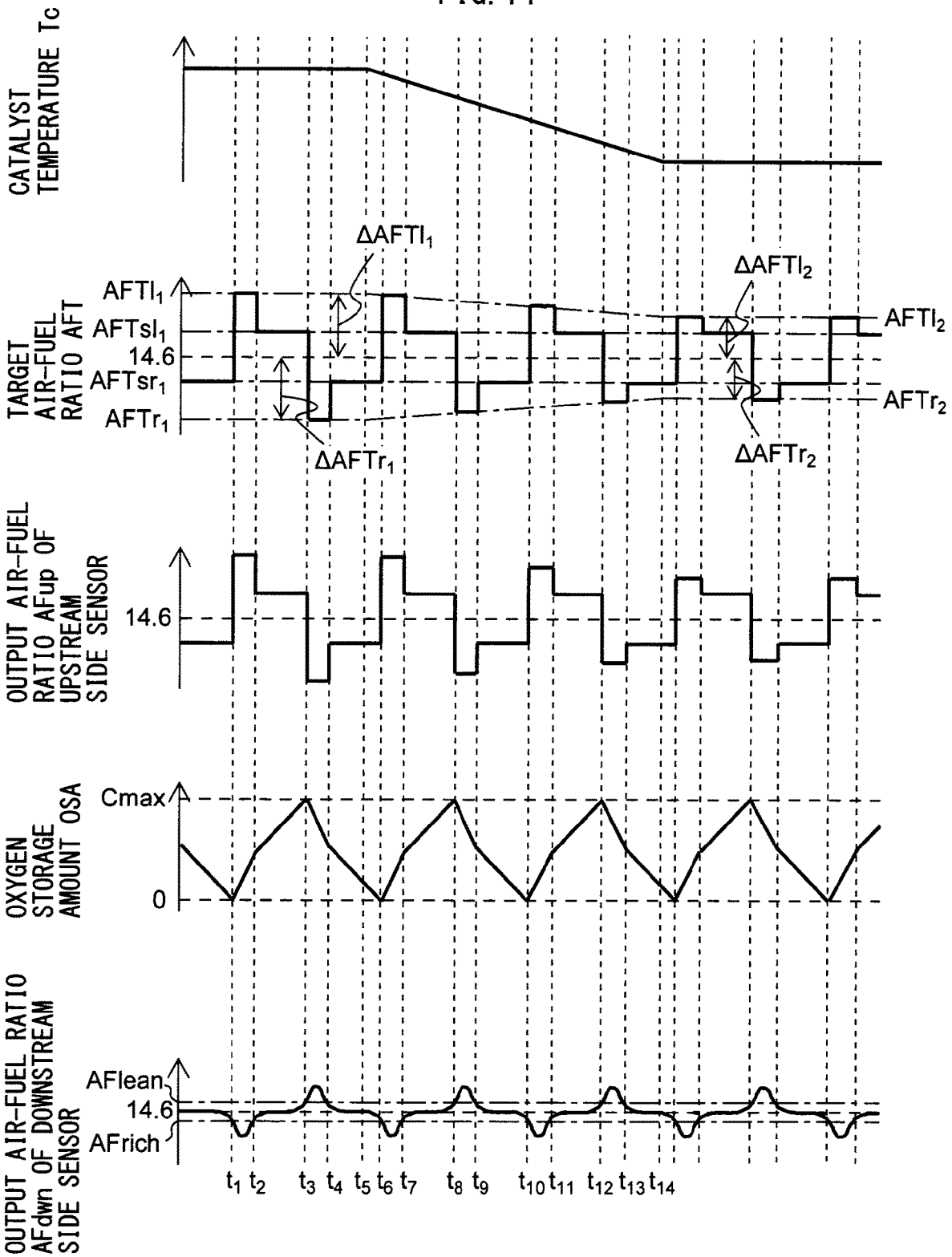
FIG. 14 is a time chart of a target air-fuel ratio, etc., when changing a rich set air-fuel ratio and lean set air-fuel ratio according to a second embodiment.

FIG. 14 is a time chart similar to FIG. 8 of the target air-fuel ratio AFT, etc., according to the present embodiment, when changing the rich set air-fuel ratio AFTr and lean set air-fuel ratio AFTl.

In the example shown in FIG. 14, after the time $t_5$, the temperature Tc of the upstream side exhaust purification catalyst 20 is gradually changed. Along with this, based on the maps shown in FIGS. 13(A) and 13(B), the lean degree of the lean set air-fuel ratio AFTl is set gradually smaller and the rich degree of the rich set air-fuel ratio AFTr is set gradually smaller.

In the example shown in FIG. 14, the temperature of the upstream side exhaust purification catalyst 20 continues to fall until the time $t_{14}$. After the time $t_{14}$, it is maintained substantially constant at a relatively low temperature. The lean set air-fuel ratio AFTl at this time is set to a second lean set air-fuel ratio $AFTl_2$ which is smaller than the first lean set air-fuel ratio $AFTl_1$. On the other hand, the rich set air-fuel ratio AFTr at this time is set to a second rich set air-fuel ratio $AFTr_2$ which is larger than the first rich set air-fuel ratio $AFTr_1$.

Further, in the present embodiment, even if the temperature of the upstream side exhaust purification catalyst 20 changes, neither of the slight lean set air-fuel ratio AFTsl and slight rich set air-fuel ratio AFTsr is changed. Therefore, in the example shown in FIG. 14, both the slight lean set air-fuel ratio AFTsl and the slight rich set air-fuel ratio AFTsr are maintained at the first slight lean set air-fuel ratio $AFTsl_1$ and the first slight rich set air-fuel ratio $AFTsr_1$, respectively.

In this way, in the present embodiment, if the temperature of the upstream side exhaust purification catalyst 20 becomes lower, that is, if the purification ability of the upstream side exhaust purification catalyst 20 falls, the lean degree of the lean set air-fuel ratio AFTl and the rich degree of the rich set air-fuel ratio AFTr are made to fall. Therefore, it is possible to effectively keep $NO_x$ or unburned gas from flowing out from the upstream side exhaust purification catalyst 20 along with a drop in the purification ability of the upstream side exhaust purification catalyst 20.

Note that, in the above embodiment, both of the lean set air-fuel ratio AFTl and the rich set air-fuel ratio AFTr are changed in accordance with the temperature of the upstream side exhaust purification catalyst 20. However, it is also possible to change only one of the lean set air-fuel ratio AFTl and the rich set air-fuel ratio AFTr in accordance with the temperature of the upstream side exhaust purification catalyst 20 and maintain the other constant as it is.

Further, in the above embodiment, the lean set air-fuel ratio AFTl, etc., are changed in accordance with the temperature of the upstream side exhaust purification catalyst 20, that is, the ability of the upstream side exhaust purification catalyst 20 to purify $NO_x$ and unburned gas. However, it is also possible to change the lean set air-fuel ratio AFTl, etc., in accordance with a parameter other than the temperature of the upstream side exhaust purification catalyst 20, as long as the parameter is a purification ability parameter which shows the purification ability of the upstream side exhaust purification catalyst 20.

As such a purification ability parameter, for example, degree of deterioration of the upstream side exhaust purification catalyst 20 may be mentioned. If the degree of deterioration of the upstream side exhaust purification catalyst 20 is high, the surface area of the precious metal which is carried at the upstream side exhaust purification catalyst 20 is decreased and the purification ability of the upstream side exhaust purification catalyst 20 falls. Therefore, if the degree of deterioration of the upstream side exhaust purification catalyst 20 becomes higher, the lean set air-fuel ratio AFTl, etc., are changed in the same way as when the temperature of the upstream side exhaust purification catalyst 20 falls.

In this regard, the degree of deterioration of the upstream side exhaust purification catalyst 20 can be detected by various methods. For example, if the degree of deterioration of the upstream side exhaust purification catalyst 20 becomes higher, the maximum storable oxygen amount Cmax of the upstream side exhaust purification catalyst 20 falls. Therefore, when performing control such as shown in FIG. 5, the degree of deterioration can be estimated based on the cumulative amount of oxygen which flows into the upstream side exhaust purification catalyst from when the output air-fuel ratio AFdwn of the downstream side air-fuel ratio sensor 41 reaches the rich judged air-fuel ratio to when it reaches the lean judged air-fuel ratio (corresponding to maximum storable oxygen amount). In this case, as the cumulative amount of oxygen becomes smaller, the degree of deterioration of the upstream side exhaust purification catalyst 20 is judged to become higher.

Modification of Second Embodiment

Next, referring to FIGS. 15 to 17, a control system according to a modification of the second embodiment will be explained. In the control system according to the modification of the second embodiment, the slight lean set air-fuel ratio AFTsl and the slight rich set air-fuel ratio AFTsr are changed in accordance with the temperature of the upstream side exhaust purification catalyst 20.

Specifically, as shown in FIG. 13(C), the slight rich set air-fuel ratio AFTsr is changed to become smaller, that is, to become larger in rich degree, as the temperature of the upstream side exhaust purification catalyst 20 becomes higher. Further, as will be understood from a comparison with the rich set air-fuel ratio shown in FIG. 13(A), if the temperature of the upstream side exhaust purification catalyst 20 is the same, the slight rich set air-fuel ratio AFTsr is set to a value larger than the rich set air-fuel ratio AFTr (value with smaller rich degree).

Similarly, in the present modification, as shown in FIG. 13(D), the slight lean set air-fuel ratio AFTsl is changed so as to become larger, that is, so as to become larger in lean degree, as the temperature of the upstream side exhaust purification catalyst 20 becomes higher. Further, as will be understood from a comparison with the lean set air-fuel ratio shown in FIG. 13(B), if the temperature of the upstream side exhaust purification catalyst 20 is the same, the slight lean set air-fuel ratio AFTsl is set to a value smaller than the lean set air-fuel ratio AFTl (value with smaller lean degree).

Figure 15:
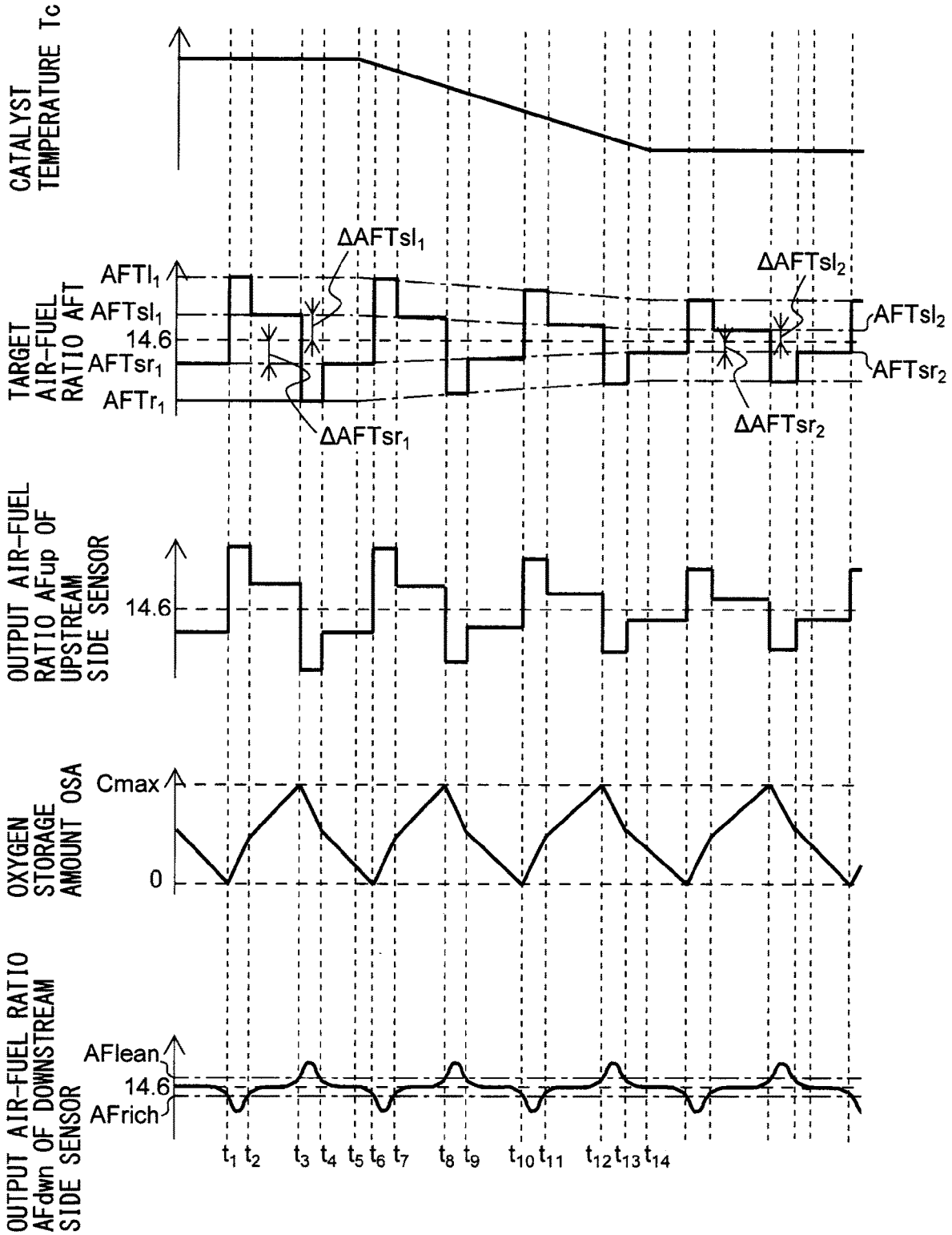
FIG. 15 is a time chart of a target air-fuel ratio, etc., when performing control for changing a lean set air-fuel ratio, etc.

FIG. 15 is a time chart similar to FIG. 14 of the target air-fuel ratio AFT, etc., when changing the rich set air-fuel ratio AFTr, etc., according to the present modification. In the example shown in FIG. 15, after the time $t_5$, the temperature of the upstream side exhaust purification catalyst 20 is gradually changed. Along with this, in the same way as the example shown in FIG. 14, the lean set air-fuel ratio AFTl is decreased and the rich set air-fuel ratio AFTr is increased.

In addition, in the example shown in FIG. 15, along with the increase in the amount of intake air Ga, the slight lean set air-fuel ratio AFTsl is gradually decreased (lean degree is made smaller) and the slight rich set air-fuel ratio AFTsr is gradually increased (rich degree is made smaller) based on the maps shown in FIGS. 13(C) and 13(D). Therefore, at the time $t_7$, the target air-fuel ratio AFT is set to a lean air-fuel ratio with a smaller lean degree than the first slight lean set air-fuel ratio $AFTsl_1$, and at the time $t_{11}$, the target air-fuel ratio AFT is set to a lean air-fuel ratio with a further smaller lean degree than the first slight lean set air-fuel ratio $AFTsl_1$. Similarly, at the time $t_9$, the target air-fuel ratio AFT is set to a rich air-fuel ratio with a smaller rich degree than the first rich set air-fuel ratio $AFTr_1$. In addition, at the time $t_{11}$, the target air-fuel ratio AFT is set to a rich air-fuel ratio with a further smaller rich degree than the first slight rich set air-fuel ratio $AFTsr_1$.

In this regard, even when the lean degree or the rich degree is small such as with the slight lean set air-fuel ratio AFTsl or the slight rich set air-fuel ratio AFTsr, when the temperature of the upstream side exhaust purification catalyst 20 is low, there is a possibility of $NO_x$ or unburned gas flowing out. To the contrary, in the control system of the present embodiment, the lower the temperature of the upstream side exhaust purification catalyst 20, the lower the lean degree of the slight lean set air-fuel ratio AFTsl and the rich degree of the slight rich set air-fuel ratio AFTsr are set. Therefore, it is possible to effectively suppress outflow of $NO_x$ or unburned gas from the upstream side exhaust purification catalyst 20 when the target air-fuel ratio AFT is set to the slight lean set air-fuel ratio AFTsl or the slight rich set air-fuel ratio AFTsr. In addition, the amount of outflow of unburned gas around the times $t_1$ to $t_3$ of FIG. 5 and the amount of outflow of $NO_x$ around the times $t_4$ to $t_6$ can be suppressed.

Figure 16:
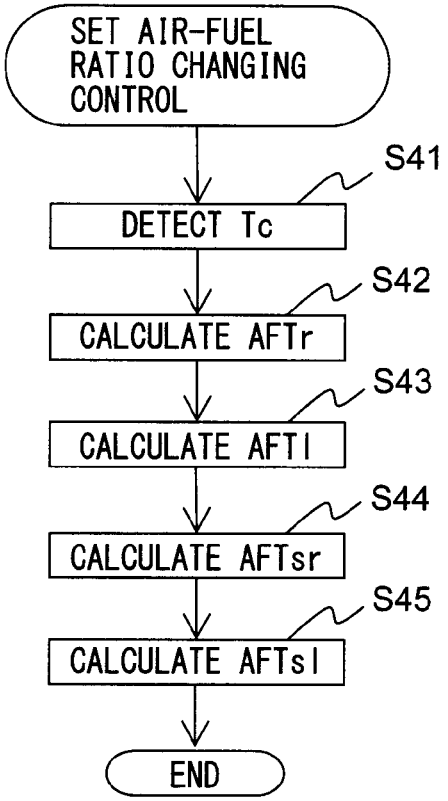
FIG. 16 is a flow chart which shows a control routine of control for changing a rich set air-fuel ratio, etc.

FIG. 16 is a flow chart which shows the control routine in control for setting the rich set air-fuel ratio, etc., in the present modification. The illustrated control routine is executed by interruption every certain time interval.

First, at step S41, the temperature sensor 46 of the upstream side exhaust purification catalyst 20 detects the temperature Tc of the upstream side exhaust purification catalyst 20. Next, at step S42, the rich set air-fuel ratio AFTr is calculated based on the temperature Tc detected at step S41, by using the map shown in FIG. 13(A). The calculated rich set air-fuel ratio AFTr is used at steps S15 and S23 of FIG. 9. Next, at step S43, the lean set air-fuel ratio AFTl is calculated based on the temperature Tc detected at step S41, by using the map shown in FIG. 13(B). The calculated lean set air-fuel ratio AFTl is used at steps S17 and S21 of FIG. 9.

Next, at step S44, the slight rich set air-fuel ratio AFTsr is calculated based on the temperature Tc detected at step S41, by using the map shown in FIG. 13(C). The calculated slight rich set air-fuel ratio AFTsr is used at step S16 of FIG. 9. Next, at step S45, the slight lean set air-fuel ratio AFTsl is calculated based on the temperature Tc detected at step S41, by using the map shown in FIG. 13(D). The calculated slight lean set air-fuel ratio AFTsl is used at step S22 of FIG. 9.

Note that, in the above embodiment and its modification, when the temperature of the upstream side exhaust purification catalyst 20 falls, the lean degree of the lean set air-fuel ratio AFTl and the rich degree of the rich set air-fuel ratio AFTr are set smaller. However, as shown in FIG. 17, even when the temperature of the upstream side exhaust purification catalyst 20 falls, the lean degree of the lean set air-fuel ratio AFTl and the rich degree of the rich set air-fuel ratio AFTr may be maintained as they are. In this case, when the temperature of the upstream side exhaust purification catalyst 20 falls, the lean degree of the slight lean set air-fuel ratio AFTsl and the rich degree of the slight rich set air-fuel ratio AFTsr are set smaller.

Figure 17:
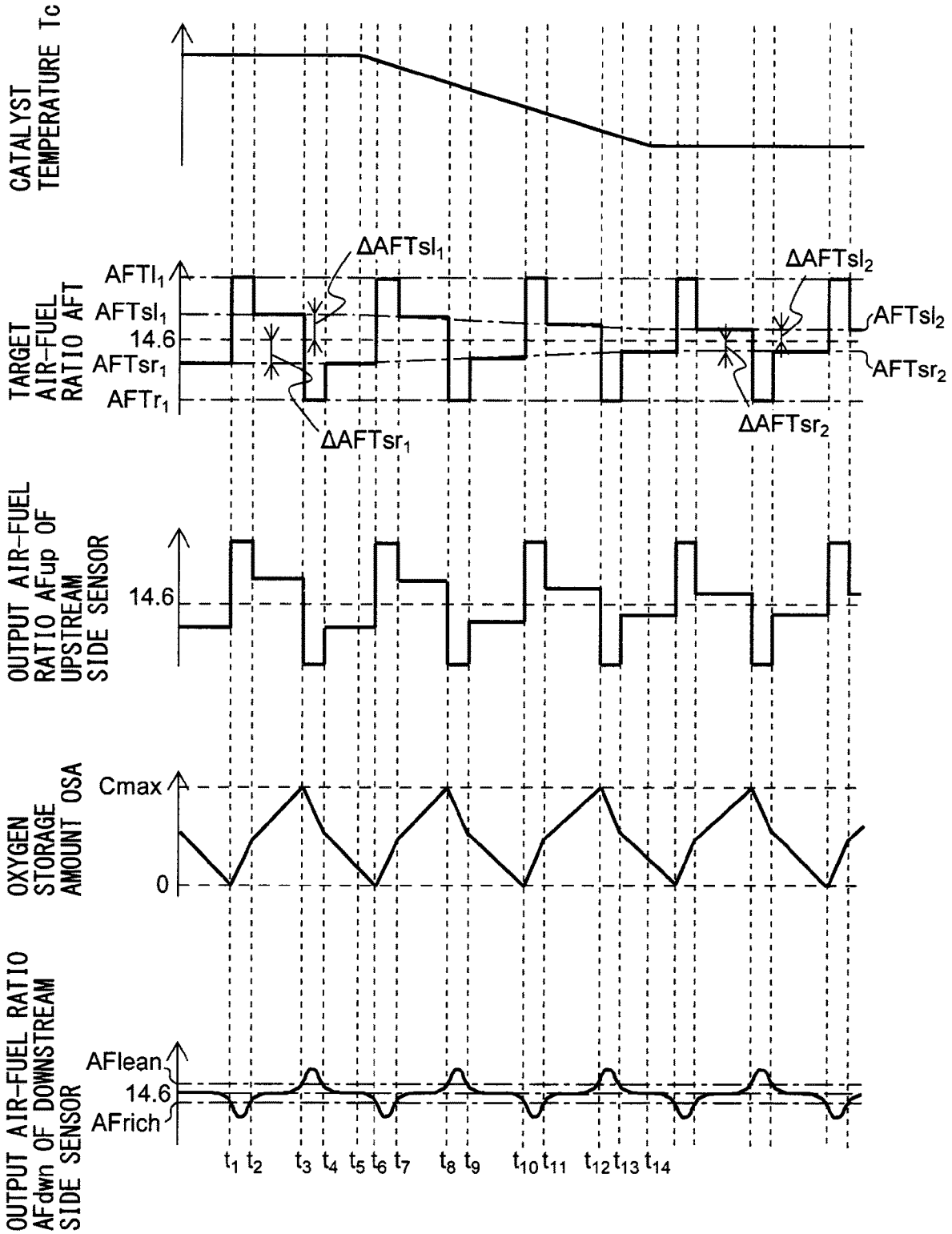
FIG. 17 is a time chart of a target air-fuel ratio, etc., when performing control for changing a slight lean set air-fuel ratio, etc.

Further, in the example shown in FIGS. 14, 15 and 17, in the time periods of the times $t_1$ to $t_2$, $t_6$ to $t_7$, $t_{10}$ to $t_{11}$, etc., the target air-fuel ratio AFT is maintained at a constant lean set air-fuel ratio AFTl. However, the lean set air-fuel ratio AFTl need not be constant in the time periods. The same is true for the rich set air-fuel ratio AFTr, slight lean set air-fuel ratio AFTsl, and slight rich set air-fuel ratio AFTsr.

If expressing the above together, in the present embodiment, when the output air-fuel ratio AFdwn of the downstream side air-fuel ratio sensor 41 becomes the rich judged air-fuel ratio AFrich or less, the target air-fuel ratio is set to the lean air-fuel ratio. In addition, when the output air-fuel ratio AFdwn of the downstream side air-fuel ratio sensor 41 becomes the lean judged air-fuel ratio or more, the target air-fuel ratio is set to the rich air-fuel ratio. Further, when the value of the parameter of the purification ability which is detected or estimated by the purification ability detection device (for example, the temperature sensor of the upstream side exhaust purification catalyst 20) is changed so that the purification ability id decreased, the lean degree is set lower than before, during at least part of the time period during which the target air-fuel ratio AFT is set to the lean air-fuel ratio and/or the rich degree is set lower than before, during at least part of the time period during which the target air-fuel ratio AFT is set to the rich air-fuel ratio.

The invention claimed is:

1. A control system of an internal combustion engine, the engine comprising: an exhaust purification catalyst which is arranged in an exhaust passage of the internal combustion engine and which can store oxygen; a downstream side air-fuel ratio sensor which is arranged at a downstream side, in the direction of exhaust flow, from said exhaust purification catalyst and which detects an air-fuel ratio of the exhaust gas flowing out from said exhaust purification catalyst; and a purification ability detector configured to detect or estimate a value of a purification ability parameter which indicates a purification ability of said exhaust purification catalyst, wherein said control system is configured to:

control an air-fuel ratio of the exhaust gas flowing into said exhaust purification catalyst, by feedback control, to become a target air-fuel ratio;

set said target air-fuel ratio to a lean air-fuel ratio which is leaner than the stoichiometric air-fuel ratio when the output air-fuel ratio of said downstream side air-fuel ratio sensor becomes equal to or less than a rich judged air-fuel ratio, which is richer than the stoichiometric air-fuel ratio;

set said target air-fuel ratio to a rich air-fuel ratio which is richer than the stoichiometric air-fuel ratio, when the output air-fuel ratio of said downstream side air-fuel ratio sensor becomes equal to or greater than a lean judged air-fuel ratio, which is leaner than the stoichiometric air-fuel ratio; and when a change in the value of the purification ability parameter, which is detected or estimated by said purification ability detector, occurs so that the purification ability falls, set a lean degree to lower than before, during at least part of a time period during which said target air-fuel ratio is set to the lean air-fuel ratio, and/or set a rich degree to lower than before, during at least part of a time period during which said target air-fuel ratio is set to the rich air-fuel ratio, and wherein said control system is configured to:

set said target air-fuel ratio to a lean set air-fuel ratio, which is leaner than the stoichiometric air-fuel ratio, when the output air-fuel ratio of said downstream side air-fuel ratio sensor becomes equal to or less than said rich judged air-fuel ratio;

set said target air-fuel ratio to a lean air-fuel ratio with a smaller lean degree than said lean set air-fuel ratio from a lean degree change timing after said target air-fuel ratio is set to said lean set air-fuel ratio and before the output air-fuel ratio of said downstream side air-fuel ratio sensor becomes equal to or greater than said lean judged air-fuel ratio, until the output air-fuel ratio of said downstream side air-fuel ratio sensor becomes equal to or greater than said lean judged air-fuel ratio; and lower a lean degree of said lean set air-fuel ratio when said change occurs.

2. The control system of the internal combustion engine according to claim 1, wherein said control system is configured, when said change occurs, to lower the lean degree of the air-fuel ratio from said lean degree change timing to when the output air-fuel ratio of said downstream side air-fuel ratio sensor becomes equal to or greater than the lean judged air-fuel ratio.

3. The control system of the internal combustion engine according to claim 1, wherein the control system is configured, even when lowering said lean degree, to set said target air-fuel ratio to equal to or greater than the lean judged air-fuel ratio.

4. A control system of an internal combustion engine, the engine comprising: an exhaust purification catalyst which is arranged in an exhaust passage of the internal combustion engine and which can store oxygen; a downstream side air-fuel ratio sensor which is arranged at a downstream side, in the direction of exhaust flow, from said exhaust purification catalyst and which detects an air-fuel ratio of the exhaust gas flowing out from said exhaust purification catalyst; and a purification ability detector configured to detect or estimate a value of a purification ability parameter which indicates a purification ability of said exhaust purification catalyst, wherein said control system is configured to:

control an air-fuel ratio of the exhaust gas flowing into said exhaust purification catalyst, by feedback control, to become a target air-fuel ratio;

set said target air-fuel ratio to a lean air-fuel ratio which is leaner than the stoichiometric air-fuel ratio when the output air-fuel ratio of said downstream side air-fuel ratio sensor becomes equal to or less than a rich judged air-fuel ratio, which is richer than the stoichiometric air-fuel ratio;

set said target air-fuel ratio to a rich air-fuel ratio which is richer than the stoichiometric air-fuel ratio, when the output air-fuel ratio of said downstream side air-fuel ratio sensor becomes equal to or greater than a lean judged air-fuel ratio, which is leaner than the stoichiometric air-fuel ratio; and when a change in the value of the purification ability parameter, which is detected or estimated by said purification ability detector, occurs so that the purification ability falls, set a lean degree to lower than before, during at least part of a time period during which said target air-fuel ratio is set to the lean air-fuel ratio, and/or set a rich degree to lower than before, during at least part of a time period during which said target air-fuel ratio is set to the rich air-fuel ratio, and wherein said control system is configured to:

set said target air-fuel ratio to a lean set air-fuel ratio, which is leaner than the stoichiometric air-fuel ratio, when the output air-fuel ratio of said downstream side air-fuel ratio sensor becomes equal to or less than said rich judged air-fuel ratio;

set said target air-fuel ratio to a lean air-fuel ratio with a smaller lean degree than said lean set air-fuel ratio from a lean degree change timing after said target air-fuel ratio is set to said lean set air-fuel ratio and before the output air-fuel ratio of said downstream side air-fuel ratio sensor becomes equal to or greater than said lean judged air-fuel ratio until the output air-fuel ratio of said downstream side air-fuel ratio sensor becomes equal to or greater than said lean judged air-fuel ratio; and when said change occurs, lower the lean degree of the air-fuel ratio from said lean degree change timing to when the output air-fuel ratio of said downstream side air-fuel ratio sensor becomes equal to or greater than the lean judged air-fuel ratio or more.

5. The control system of the internal combustion engine according to claim 4, wherein the control system is configured, even when lowering said lean degree, to set said target air-fuel ratio to equal to or greater than the lean judged air-fuel ratio.

6. A control system of an internal combustion engine, the engine comprising: an exhaust purification catalyst which is arranged in an exhaust passage of the internal combustion engine and which can store oxygen; a downstream side air-fuel ratio sensor which is arranged at a downstream side, in the direction of exhaust flow, from said exhaust purification catalyst and which detects an air-fuel ratio of the exhaust gas flowing out from said exhaust purification catalyst; and a purification ability detector configured to detect or estimate a value of a purification ability parameter which indicates a purification ability of said exhaust purification catalyst, wherein said control system is configured to:

control an air-fuel ratio of the exhaust gas flowing into said exhaust purification catalyst, by feedback control, to become a target air-fuel ratio;

set said target air-fuel ratio to a lean air-fuel ratio which is leaner than the stoichiometric air-fuel ratio when the output air-fuel ratio of said downstream side air-fuel ratio sensor becomes equal to or less than a rich judged air-fuel ratio, which is richer than the stoichiometric air-fuel ratio;

set said target air-fuel ratio to a rich air-fuel ratio which is richer than the stoichiometric air-fuel ratio, when the output air-fuel ratio of said downstream side air-fuel ratio sensor becomes equal to or greater than a lean judged air-fuel ratio, which is leaner than the stoichiometric air-fuel ratio; and when a change in the value of the purification ability parameter, which is detected or estimated by said purification ability detector, occurs so that the purification ability falls, set a lean degree to lower than before, during at least part of a time period during which said target air-fuel ratio is set to the lean air-fuel ratio, and/or set a rich degree to lower than before, during at least part of a time period during which said target air-fuel ratio is set to the rich air-fuel ratio, and wherein said control system is configured to:

set said target air-fuel ratio to a rich set air-fuel ratio, which is richer than the stoichiometric air-fuel ratio, when the output air-fuel ratio of said downstream side air-fuel ratio sensor becomes equal to or greater than said lean judged air-fuel ratio;

set said target air-fuel ratio to a rich air-fuel ratio with a smaller rich degree than said rich set air-fuel ratio from a rich degree change timing after said target air-fuel ratio is set to said rich set air-fuel ratio and before the output air-fuel ratio of said downstream side air-fuel ratio sensor becomes equal to or less than said rich judged air-fuel ratio, until the output air-fuel ratio of said downstream side air-fuel ratio sensor becomes equal to or less than said rich judged air-fuel ratio; and lower a rich degree of said rich set air-fuel ratio when said change occurs.

7. The control system of the internal combustion engine according to claim 6, wherein said control system is configured, when said change occurs, to lower the rich degree of the air-fuel ratio from said rich degree change timing to when the output air-fuel ratio of said downstream side air-fuel ratio sensor becomes equal to or less than the rich judged air-fuel ratio.

8. The control system of the internal combustion engine according to claim 6, wherein the control system is configured, even when lowering said rich degree, to set said target air-fuel ratio to equal to or less than the rich judged air-fuel ratio.

9. A control system of an internal combustion engine, the engine comprising: an exhaust purification catalyst which is arranged in an exhaust passage of the internal combustion engine and which can store oxygen; a downstream side air-fuel ratio sensor which is arranged at a downstream side, in the direction of exhaust flow, from said exhaust purification catalyst and which detects an air-fuel ratio of the exhaust gas flowing out from said exhaust purification catalyst; and a purification ability detector configured to detect or estimate a value of a purification ability parameter which indicates a purification ability of said exhaust purification catalyst, wherein said control system is configured to:

control an air-fuel ratio of the exhaust gas flowing into said exhaust purification catalyst, by feedback control, to become a target air-fuel ratio;

set said target air-fuel ratio to a lean air-fuel ratio which is leaner than the stoichiometric air-fuel ratio when the output air-fuel ratio of said downstream side air-fuel ratio sensor becomes equal to or less than a rich judged air-fuel ratio, which is richer than the stoichiometric air-fuel ratio;

set said target air-fuel ratio to a rich air-fuel ratio which is richer than the stoichiometric air-fuel ratio, when the output air-fuel ratio of said downstream side air-fuel ratio sensor becomes equal to or greater than a lean judged air-fuel ratio, which is leaner than the stoichiometric air-fuel ratio; and when a change in the value of the purification ability parameter, which is detected or estimated by said purification ability detector, occurs so that the purification ability falls, set a lean degree to lower than before, during at least part of a time period during which said target air-fuel ratio is set to the lean air-fuel ratio, and/or set a rich degree to lower than before, during at least part of a time period during which said target air-fuel ratio is set to the rich air-fuel ratio, and wherein said control system is configured to:

set said target air-fuel ratio to a rich set air-fuel ratio, which is richer than the stoichiometric air-fuel ratio, when the output air-fuel ratio of said downstream side air-fuel ratio sensor becomes equal to or greater than said lean judged air-fuel ratios;

set said target air-fuel ratio to a rich air-fuel ratio with a smaller rich degree than said rich set air-fuel ratio from a rich degree change timing after said target air-fuel ratio is set to said rich set air-fuel ratio and before the output air-fuel ratio of said downstream side air-fuel ratio sensor becomes equal to or less than said rich judged air-fuel ratio until the output air-fuel ratio of said downstream side air-fuel ratio sensor becomes equal to or less than said rich judged air-fuel ratio or less; and when said change occurs, lower the rich degree of the air-fuel ratio from said rich degree change timing to when the output air-fuel ratio of said downstream side air-fuel ratio sensor becomes equal to or less than the rich judged air-fuel ratio or less.

10. The control system of the internal combustion engine according to claim 9, wherein the control system is configured, even when lowering said rich degree, to set said target air-fuel ratio to equal to or less than the rich judged air-fuel ratio.

* * * * *